US011056272B2

(12) United States Patent
Song et al.

(10) Patent No.: US 11,056,272 B2
(45) Date of Patent: Jul. 6, 2021

(54) INDUCTOR

(71) Applicant: SAMSUNG ELECTRO-MECHANICS CO., LTD., Suwon-Si (KR)

(72) Inventors: Sung Min Song, Suwon-Si (KR); Yoon Hee Cho, Suwon-Si (KR); Hwan Soo Lee, Suwon-Si (KR)

(73) Assignee: SAMSUNG ELECTRO-MECHANICS CO., LTD., Suwon-si (KR)

( * ) Notice: Subject to any disclaimer, the term of this patent is extended or adjusted under 35 U.S.C. 154(b) by 269 days.

(21) Appl. No.: 16/114,944

(22) Filed: Aug. 28, 2018

(65) Prior Publication Data

US 2019/0244742 A1 Aug. 8, 2019

(30) Foreign Application Priority Data

Feb. 8, 2018 (KR) ..... 10-2018-0015873

(51) Int. Cl.
*H01F 27/29* (2006.01)
*H01F 27/28* (2006.01)
(Continued)

(52) U.S. Cl.
CPC ..... *H01F 27/2804* (2013.01); *H01F 17/0013* (2013.01); *H01F 27/29* (2013.01);
(Continued)

(58) Field of Classification Search
CPC ..... H01F 27/2804; H01F 27/292; H01F 17/0013; H01F 27/324; H01F 2017/048; H01F 2027/2809; H01F 27/2828
See application file for complete search history.

(56) References Cited

U.S. PATENT DOCUMENTS 10,020,112 B2 * 7/2018 Yoon ..... H01F 17/0013
2014/0022693 A1 * 1/2014 Kim ..... H01G 4/30 361/301.4
(Continued)

FOREIGN PATENT DOCUMENTS

JP 07-201572 A 8/1995
JP 8-55727 A 2/1996
(Continued)

OTHER PUBLICATIONS

US 9,978,509 B2, 05/2018, Yoon et al. (withdrawn)
(Continued)

*Primary Examiner* — Tuyen T Nguyen
(74) *Attorney, Agent, or Firm* — Morgan, Lewis & Bockius LLP

(57) ABSTRACT

An inductor includes first and second external electrodes spaced apart from each other, a substrate disposed between the first and second external electrodes and having a first surface and a second surface opposing each other, and a conductive structure electrically connected to the first and second external electrodes. The conductive structure includes a first conductive pattern disposed on the first surface of the substrate, a second conductive pattern disposed on the second surface of the substrate, and at least one reinforcing portion. The first conductive pattern has a first side facing the first external electrode, the second conductive pattern has a second side facing the second external electrode, and the at least one reinforcing portion is electrically connected to at least one of the first and second sides and is interposed between the substrate and at least one of the first and second external electrodes.

17 Claims, 18 Drawing Sheets

(51) Int. Cl.

| | |
|---|---|
| ***H01F 17/00*** | (2006.01) |
| ***H01F 27/32*** | (2006.01) |
| *H01F 17/04* | (2006.01) |

(52) U.S. Cl.
CPC ..... *H01F 27/292* (2013.01); *H01F 27/324* (2013.01); *H01F 2017/048* (2013.01); *H01F 2027/2809* (2013.01)

(56) References Cited

U.S. PATENT DOCUMENTS

| | | | |
|---|---|---|---|
| 2016/0042857 | A1 | 2/2016 | Chun et al. |
| 2016/0163444 | A1 | 6/2016 | Choi et al. |
| 2016/0189840 | A1 | 6/2016 | Ahn et al. |
| 2017/0178798 | A1 | 6/2017 | Yoon et al. |
| 2019/0066908 | A1 | 2/2019 | Ueda et al. |

FOREIGN PATENT DOCUMENTS

| | | | |
|---|---|---|---|
| JP | 08-078279 | A | 3/1996 |
| JP | 2018-019059 | A | 2/2017 |
| JP | 2017-112354 | A | 6/2017 |
| KR | 10-2016-0019266 | A | 2/2016 |
| KR | 10-1598295 | B1 | 2/2016 |
| KR | 10-2017-0073174 | A | 6/2017 |
| KR | 10-2017-0103422 | A | 9/2017 |
| WO | 2017/199461 | A1 | 11/2017 |

OTHER PUBLICATIONS

Office Action issued in corresponding Korean Application No. 10-2018-0015873, dated Mar. 20, 2019.
Japanese Office Action dated Jan. 29, 2019 issued in Japanese Patent Application No. 2018-164900 (with English translation).
Office Action issued in corresponding Japanese Patent Application No. 2018-164900, dated Aug. 27, 2019.

* cited by examiner

INDUCTOR

CROSS-REFERENCE TO RELATED APPLICATION(S)

This application claims the benefit of priority to Korean Patent Application No. 10-2018-0015873 filed on Feb. 8, 2018 in the Korean Intellectual Property Office, the disclosure of which is incorporated herein by reference in its entirety.

BACKGROUND

1. Field

The present disclosure relates to an inductor, and more particularly, to an inductor capable of enhanced reliability.

2. Description of Related Art

Inductors are used in electronic devices such as digital televisions (TVs), mobile phones, notebook PCs, and the like. Recently, with the trend for reducing electronic devices in size and thickness, inductors used in electronic devices are also increasingly required to be miniaturized. Thus, reliability of inductors may be lowered, in the case that inductors are miniaturized.

SUMMARY

An aspect of the present disclosure may provide an inductor having enhanced electrical characteristics.

An aspect of the present disclosure may also provide an inductor having enhanced reliability.

According to an aspect of the present disclosure, an inductor may include first and second external electrodes spaced apart from each other, a substrate disposed between the first and second external electrodes and having a first surface and a second surface opposing each other, and a conductive structure electrically connected to the first and second external electrodes. The conductive structure includes a first conductive pattern disposed on the first surface of the substrate, a second conductive pattern disposed on the second surface of the substrate, and at least one reinforcing portion. The first conductive pattern has a first side facing the first external electrode, the second conductive pattern has a second side facing the second external electrode, and the at least one reinforcing portion is connected to at least one of the first and second sides and is interposed between the substrate and at least one of the first and second external electrodes.

According to another aspect of the present disclosure, an inductor may include a body, first and second external electrodes disposed on external surfaces of the body and spaced apart from each other, a substrate disposed in the body and having a first surface and a second surface opposing each other, and a conductive structure disposed in the body. The conductive structure includes a first conductive pattern disposed on the first surface of the substrate, a second conductive pattern disposed on the second surface of the substrate, a connection via penetrating through the substrate and electrically connecting the first and second conductive patterns, a first reinforcing portion in contact with the first external electrode, and a second reinforcing portion in contact with the second external electrode. The first conductive pattern has a first side facing the first external electrode and in contact with the first external electrode, the second conductive pattern has a second side facing the second external electrode and in contact with the second external electrode, the first reinforcing portion is connected to the first side and is interposed between the substrate and the first external electrode, and the second reinforcing portion is connected to the second side and is interposed between the substrate and the second external electrode.

BRIEF DESCRIPTION OF DRAWINGS

The above and other aspects, features, and advantages of the present disclosure will be more clearly understood from the following detailed description taken in conjunction with the accompanying drawings, in which.

DETAILED DESCRIPTION

Hereinafter, exemplary embodiments of the present disclosure will now be described in detail with reference to the accompanying drawings.

Figure 1:
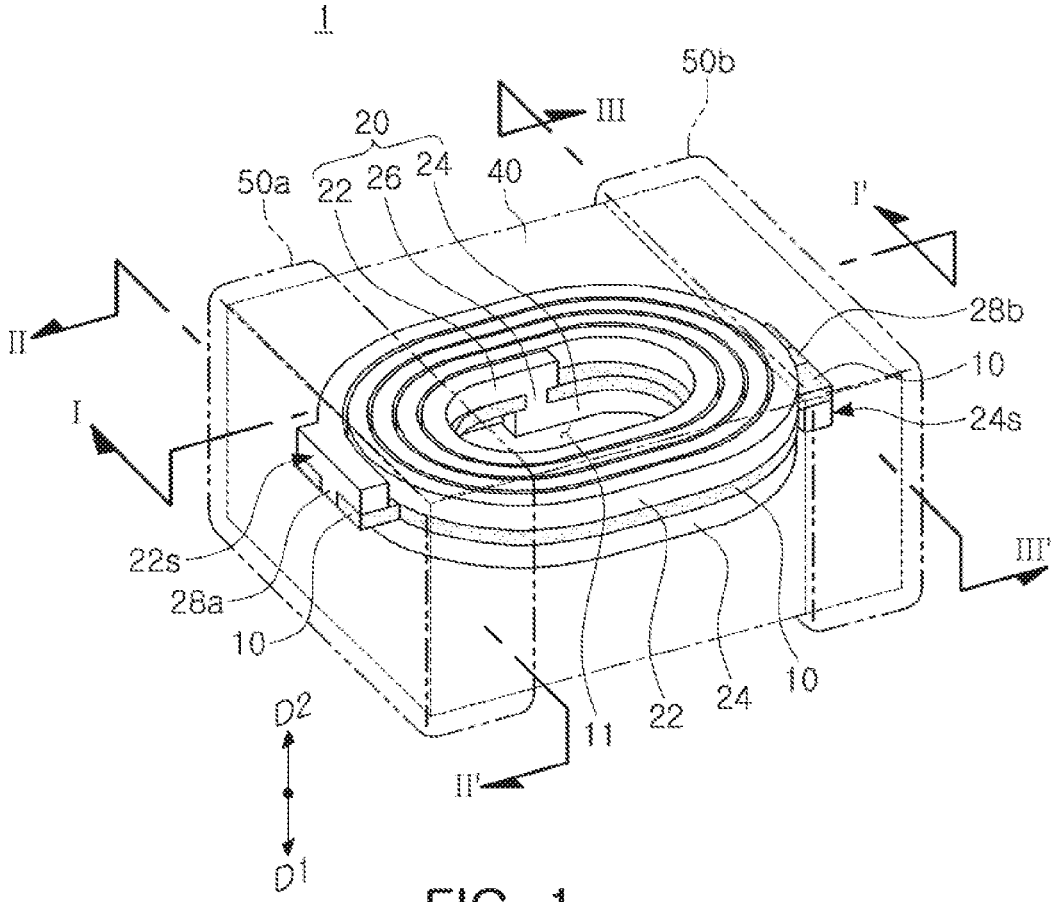
FIG. 1 is a perspective view illustrating an example of an inductor according to an exemplary embodiment in the present disclosure.

An inductor according to an exemplary embodiment in the present disclosure will be described with reference to FIGS. 1 and 2. FIG. 1 is a perspective view schematically illustrating an inductor according to an exemplary embodiment in the present disclosure, while FIG. 2 is a cross-sectional view schematically illustrating a region taken along line I-I' of FIG. 1.

Figure 2:
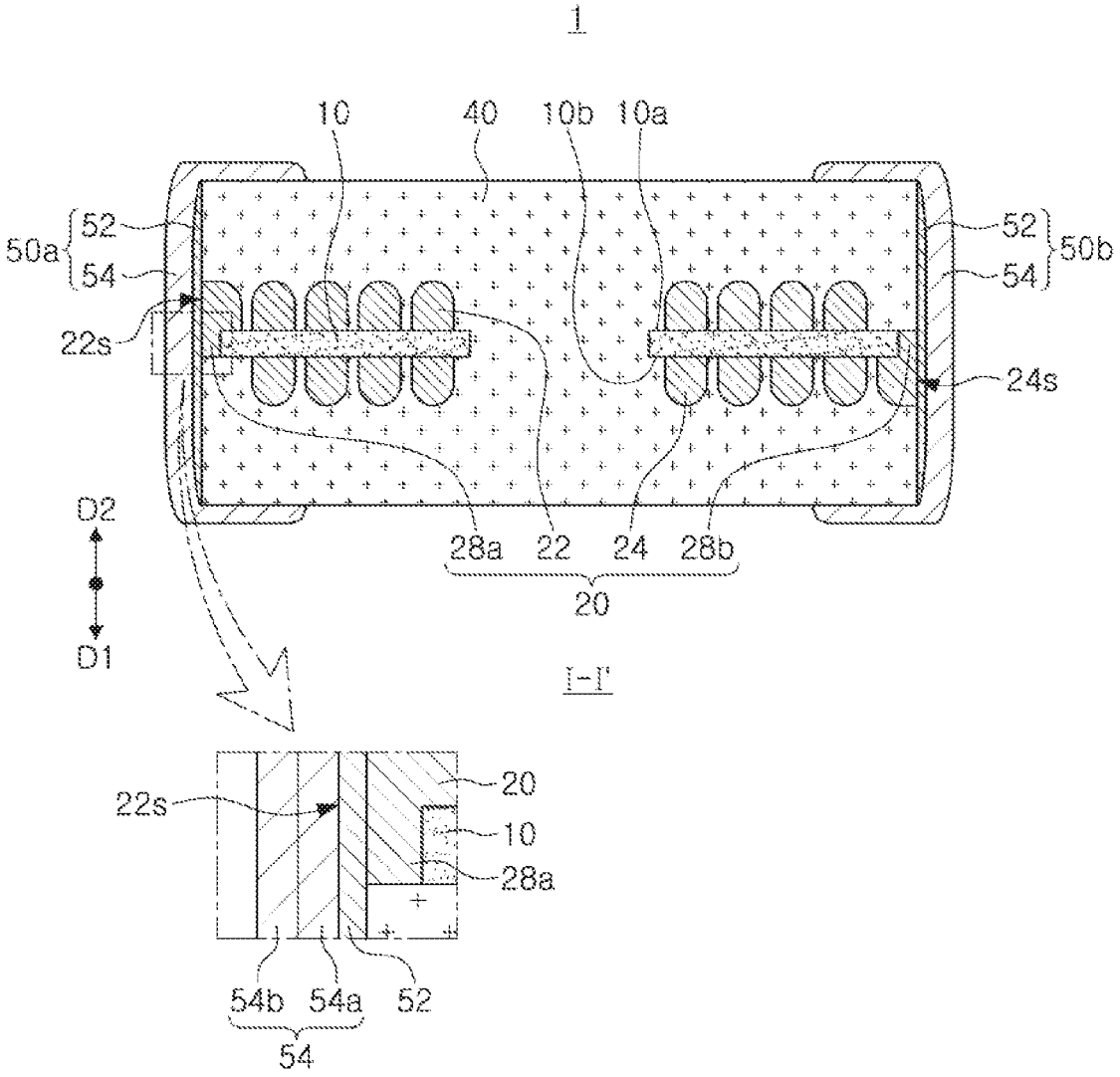
FIG. 2 is a cross-sectional view illustrating an example of an inductor according to an exemplary embodiment in the present disclosure.

Referring to FIGS. 1 and 2, an inductor 1 according to an exemplary embodiment in the present disclosure may include a substrate 10, a conductive structure 20, a body 40, and external electrodes 50*a* and 50*b*.

The external electrodes 50*a* and 50*b* may include a first external electrode 50*a* and a second external electrode 50*b* that are spaced apart from each other.

The body 40 may be disposed between the first external electrode 50*a* and the second external electrode 50*b*. In an example, the body 40 may be formed of a material including a magnetic material dispersed in an insulating polymer. For example, the body 40 may be formed of a composite material including a ferrite or a metal-based soft magnetic material dispersed in an insulating polymer. The body 40 may include, for example, a ferrite, such as a Mn—Zn-based ferrite, a Ni—Zn-based ferrite, a Ni—Zn—Cu-based ferrite, a Mn—Mg-based ferrite, a Ba-based ferrite, a Li-based ferrite, and the like. Alternatively, the body 40 may include a metal-based soft magnetic material that may be an alloy including any one or more selected from the group consisting of Fe, Si, Cr, Al, and Ni. The metal-based soft magnetic material may include, for example, an Fe—Si—B—Cr-based amorphous metal particle. The metal-based soft magnetic material may have a particle size greater than or equal to 0.1 μm and less than or equal to 20 μm, and may be dispersed in an insulating polymer, such as an epoxy resin or polyimide, or the like.

In an example, the body 40 may have a hexahedral shape. The first and second external electrodes 50*a* and 50*b* may cover both side surfaces of the body 40 opposing each other.

In an example, the first and second external electrodes 50*a* and 50*b* may extend in directions facing each other along external surfaces of the body 40 while covering both side surfaces of the body 40 opposing each other. For example, each of the first and second external electrodes 50*a* and 50*b* may have a shape of "C" or "U", when viewed in a cross section as shown in FIG. 2. However, the technical idea of the present disclosure is not limited thereto, and each of the first and second external electrodes 50*a* and 50*b* may be modified to have a cross section having a shape of "L" or "I".

Each of the first and second external electrodes 50*a* and 50*b* may include an inner conductive layer 52 and an outer conductive layer 54. The outer conductive layer 54 may cover the inner conductive layer 54.

The substrate 10 may be disposed between the first external electrode 50*a* and the second external electrode 50*b*, and disposed in the body 40. The substrate 10 may be formed of an insulating resin. For example, the substrate 10 may be formed of a thermosetting resin, such as an epoxy resin, and the like, a thermoplastic resin, such as polyimide, and the like, or a resin (for example, a pre-preg, an ajinomoto build-up film (ABF), FR-4, a bismaleimide triazine (BT) resin, a photoimageable dielectric (PID), and the like) formed by impregnating a reinforcement material, such as a glass fiber or an inorganic filler, with the thermosetting resin and the thermoplastic resin. The substrate 10 may have a first surface 10*a* and a second surface 10*b* that oppose each other.

In an example, a central portion of the substrate 10 may be filled by the body 40. The body 40 that may include a magnetic material as described above may be formed in the central portion of the substrate 10, and thus an inductance may be enhanced.

The conductive structure 20 may be disposed between the first external electrode 50*a* and the second external electrode 50*b*. The conductive structure 20 may be disposed in the body 40 and may be electrically connected to the first external electrode 50*a* and the second external electrode 50*b*.

The conductive structure 20 may include a first conductive pattern 22, a second conductive pattern 24, a connection via 26, and at least one reinforcing portion, for example, reinforcing portions 28*a* and 28*b*.

The first conductive pattern 22 may be disposed on the first surface 10*a* of the substrate 10. The first conductive pattern 22 may have a first side 22*s* facing the first external electrode 50*a* and in contact with the first external electrode 50*a*. The second conductive pattern 24 may be disposed on the second surface 10*b* of the substrate 10. The second conductive pattern 24 may have a second side 24*s* facing the second external electrode 50*b* and in contact with the second external electrode 50*b*. At least one of the reinforcing portions 28*a* and 28*b* may be connected to at least one of the first and second side portions 22*s* and 24*s*, and be disposed between the substrate 10 and at least one of the first and second external electrodes 50*a* and 50*b*. The connection via 26 may penetrate through the substrate 10 and may electrically connect the first and second conductive patterns 22 and 24.

In an example, each of the first and second conductive patterns 22 and 24 may have a shape of a coil. Accordingly, in exemplary embodiments of the present disclosure, the first conductive pattern 22 may be referred to as a "first coil" or an "upper coil" and the second conductive pattern 24 may be referred to as a "second coil" or a "lower coil." In addition, the conductive structure 20 may be referred to as an "inner electrode" or an "inner coil."

In an example, each of the first and second conductive patterns 22 and 24 may have two or more turns on a plane, in order to implement a high inductance while reducing a thickness.

In an example, the first and second conductive patterns 22 and 24, and the connection via 26 may be integrally formed. For example, the first and second conductive patterns 22 and 24, and the connection via 26 may be formed by the same plating process. However, the technical idea of the present disclosure is not limited thereto. For example, at least one of the first and second conductive patterns 22 and 24, and the connection via 26 may be formed by a different process.

In an example, each of the first conductive pattern 22, the second conductive pattern 24, and the connection via 26 may be formed of silver (Ag), palladium (Pd), aluminum (Al), nickel (Ni), titanium (Ti), gold (Au), copper (Cu), platinum (Pt), alloys thereof, and the like.

In an example, the reinforcing portions 28*a* and 28*b* may include a first reinforcing portion 28*a* extending from at least a portion of the first side 22*s* of the first conductive pattern 22 in a first direction D1, and a second reinforcing portion 28*b* extending from at least a portion of the second side 24*s* of the second conductive pattern 24 in a second direction D2. The first direction D1 may be a direction from the first surface 10*a* of the substrate 10 to the second surface 10*b* of the substrate 10, and the second direction D2 may be a direction from the second surface 10*b* of the substrate 10 to the first surface 10*a* of the substrate 10.

The first reinforcing portion 28*a* may be interposed between the substrate 10 and the first external electrode 50*a*, and the second reinforcing portion 28*b* may be interposed between the substrate 10 and the second external electrode 50*b*.

The first side 22*s* of the first conductive pattern 22 and the first reinforcing portion 28*a* may be electrically connected to the first external electrode 50*a*. The first side 22*s* of the first conductive pattern 22 and the first reinforcing portion 28*a* may be in contact with the inner conductive layer 52 of the first external electrode 50*a*.

The second side 24*s* of the second conductive pattern 24 and the second reinforcing portion 28*b* may be electrically connected to the second external electrode 50*b*. The second side 24*s* of the second conductive pattern 24 and the second reinforcing portion 28*b* may be in contact with the inner conductive layer 52 of the second external electrode 50*b*.

In each of the first and second external electrodes 50*a* and 50*b*, the inner conductive layer 52 may be in contact with the conductive structure 20, and the outer conductive layer 54 may cover the inner conductive layer 52 and may be spaced apart from the conductive structure 20.

In an example, the outer conductive layer 54 may include a first conductive layer 54*a* and a second conductive layer 54*b*. The first conductive layer 54*a* may cover the inner conductive layer 52, and the second conductive layer 54*b* may cover the first conductive layer 54*a*.

The inner conductive layer 52 may be formed of a plating layer. For example, the inner conductive layer 52 may be formed of a copper plating layer. The first conductive layer 54*a* of the outer conductive layer 54 may be formed of a metal-epoxy material, for example, a silver-epoxy mixture. The second conductive layer 54*b* of the outer conductive layer 54 may be formed of any one of nickel (Ni) and tin (Sn), or a mixture thereof.

The first and second reinforcing portions 28*a* and 28*b* may be in direct contact with the inner conductive layer 52.

The inner conductive layer 52 may overlap an entirety of the substrate 10 in a thickness direction, and the first and second reinforcing portions 28*a* and 28*b* may be in direct contact with the inner conductive layer 52 where the inner conductive layer 52 overlaps the substrate 10 in the thickness direction. In some embodiments, the first and/or second reinforcing portions 28*a* and 28*b* may be in direct contact with the inner conductive layer 52 across an entire extent of where the inner conductive layer 52 overlaps the substrate 10 in the thickness direction.

Next, various examples of the first reinforcing portion 28*a* will be described with reference to FIGS. 3A through 3G. FIGS. 3A through 3G are partial perspective views illustrating various examples of the first reinforcing portion 28*a*.

Figure 3A:
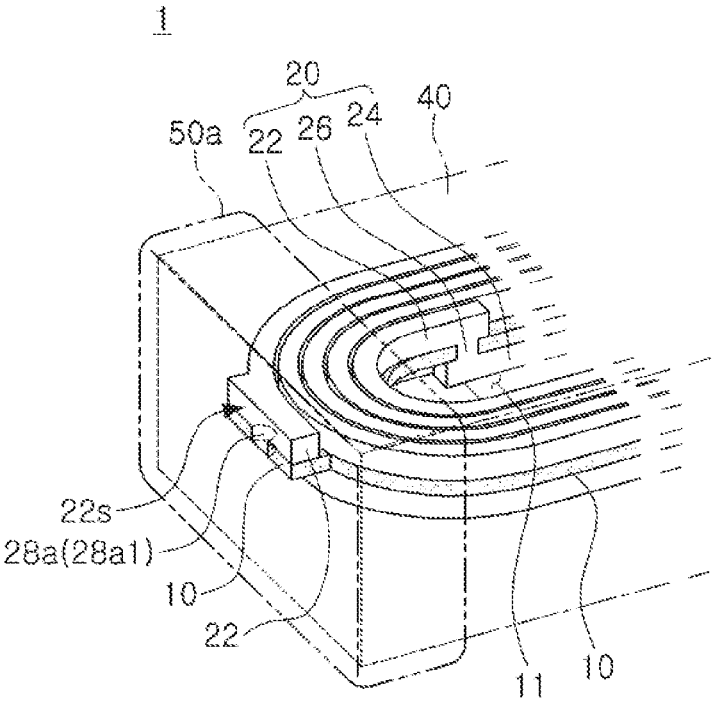
FIG. 3A is a partial perspective view illustrating an example of a portion of an inductor according to an exemplary embodiment in the present disclosure.

In an example, referring to FIG. 3A together with FIGS. 1 and 2, the first reinforcing portion 28*a* may be a first reinforcing portion 28*a*1 having a hemispherical shape, when viewed in a plan view or a top view. Here, viewing in the plan view or the top view may include viewing in a direction toward the first surface 10*a* of the substrate 10. A shape of the first reinforcing portion 28*a*1 when viewed in a plan view or a top view may be understood as a shape on the same plane as the first surface 10*a* of the substrate 10, or a shape on the same plane as the second surface 10*b* of the substrate 10. Accordingly, the expression "plane shape" used herein may be understood to be a shape viewed in the second direction D2 or the first direction D1, a shape on the same plane as the first surface 10*a* of the substrate 10, a shape on the same plane as the second surface 10*b* of the substrate 10, or a shape viewed in a top view toward the first surface 10*a*, unless otherwise specified.

The first reinforcing portion 28*a*1 may extend from any one portion of the first side 22*s* of the first conductive pattern 22 in the first direction D1. Also, as described above, a plane shape of the first reinforcing portion 28*a*1 may be a hemispherical shape.

Figure 3B:
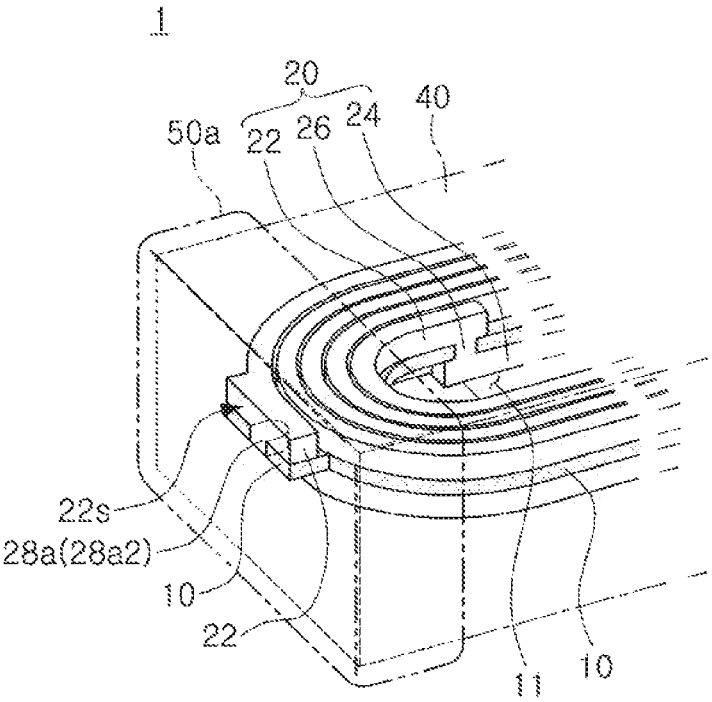
FIG. 3B is a partial perspective view illustrating a modified example of a portion of an inductor according to an exemplary embodiment in the present disclosure.

In a modified example, referring to FIG. 3B together with FIGS. 1 and 2, the first reinforcing portion 28*a* may be a first reinforcing portion 28*a*2 having a shape of an elongated hemisphere with a constant width when viewed in a plan view or a top view.

Figure 3C:
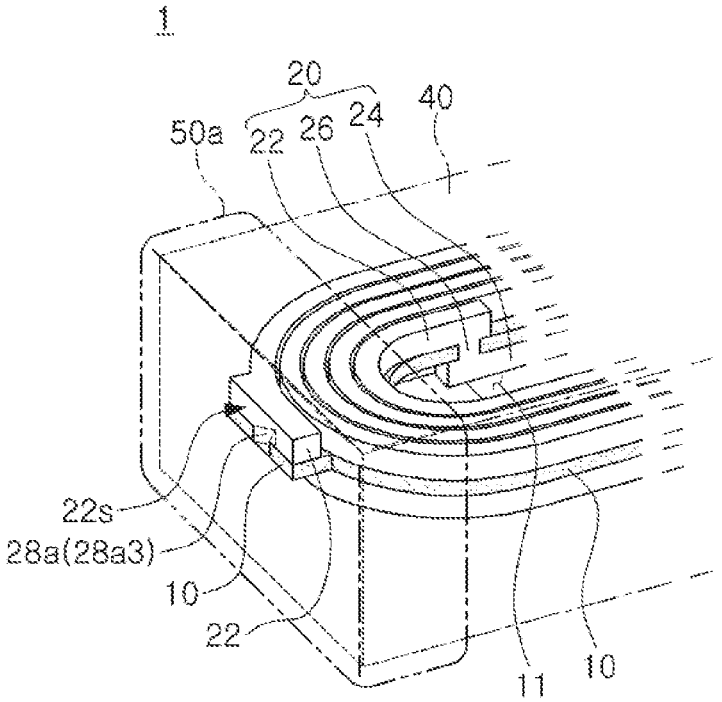
FIG. 3C is a partial perspective view illustrating a modified example of a portion of an inductor according to an exemplary embodiment in the present disclosure.

In a modified example, referring to FIG. 3C together with FIGS. 1 and 2, the first reinforcing portion 28*a* may be a first reinforcing portion 28*a*3 having a triangular shape with a width gradually decreasing in a direction from the first external electrode 50*a* toward the substrate 10, when viewed in a plan view or a top view.

Figure 3D:
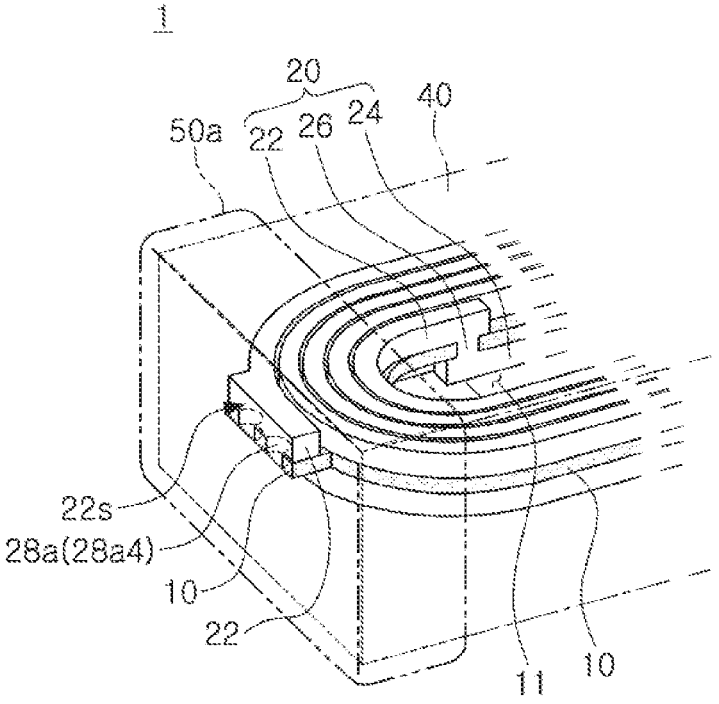
FIG. 3D is a partial perspective view illustrating a modified example of a portion of an inductor according to an exemplary embodiment in the present disclosure.

In a modified example, referring to FIG. 3D together with FIGS. 1 and 2, the first reinforcing portion 28*a* may be a plurality of first reinforcing portions 28*a*4 extending from a plurality of portions of the first side 22*s* of the first conductive pattern 22 in the first direction D1. Each of the plurality of first reinforcing portions 28*a*4 may have a hemispherical shape as described above with reference to FIG. 3A, when viewed in a top view. Also, although two first reinforcing portions 28*a*4 are shown in FIG. 3D among the plurality of first reinforcing portions 28*a*4, the technical idea of the present disclosure is not limited thereto. For example, the plurality of first reinforcing portions 28*a*4 may extend from three or more portions of the first side 22*s* of the first conductive pattern 22. Accordingly, the term "plurality" mentioned below may be understood to include two or three or more, unless otherwise specified.

Figure 3E:
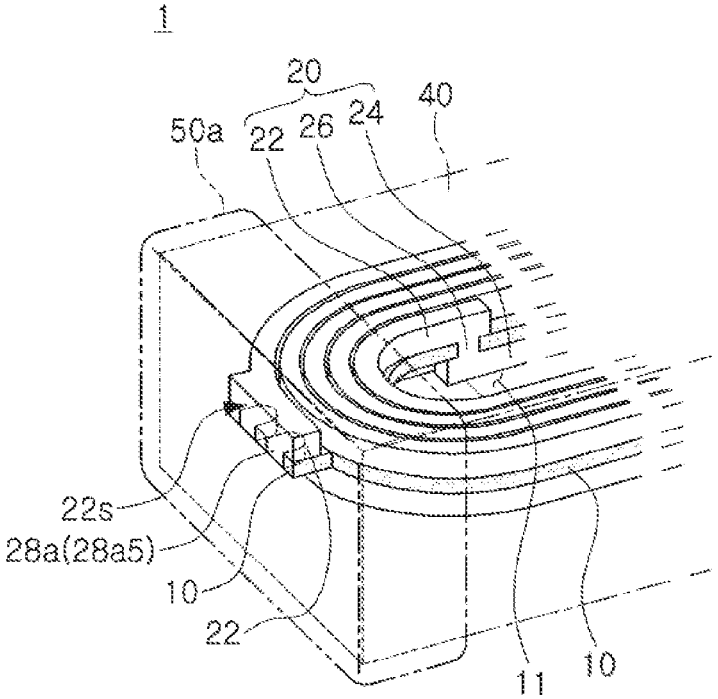
FIG. 3E is a partial perspective view illustrating a modified example of a portion of an inductor according to an exemplary embodiment in the present disclosure.

In a modified example, referring to FIG. 3E together with FIGS. 1 and 2, the first reinforcing portion 28*a* may be a plurality of first reinforcing portions 28*a*5 extending from a plurality of portions of the first side 22*s* of the first conductive pattern 22 in the first direction D1. Each of the plurality of first reinforcing portions 28*a*5 may have a shape of an elongated hemisphere as described above with reference to FIG. 3B, when viewed in a plan view.

Figure 3F:
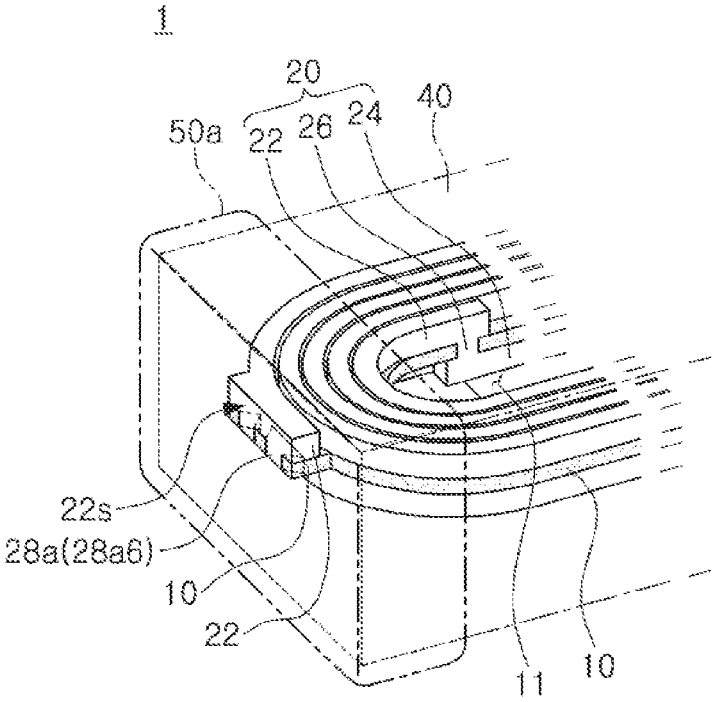
FIG. 3F is a partial perspective view illustrating a modified example of a portion of an inductor according to an exemplary embodiment in the present disclosure.

In a modified example, referring to FIG. 3F together with FIGS. 1 and 2, the first reinforcing portion 28*a* may be a plurality of first reinforcing portions 28*a*6 extending from a plurality of portions of the first side 22*s* of the first conductive pattern 22 in the first direction D1. Each of the plurality of first reinforcing portions 28*a*6 may have a triangular shape as described above with reference to FIG. 3C, when viewed in a plan view. In a horizontal direction, the plurality of first reinforcing portions 28*a*6 may include a reinforcing portion having a width gradually decreasing in a direction from the first external electrode 50*a* toward the substrate 10, and a reinforcing portion having a width gradually increasing in a direction from the substrate 10 toward the first external electrode 50*a*. In an example, when viewed in the plan view, any one reinforcing portion among the plurality of first reinforcing portions 28*a*6 may have a triangular shape with a gradually decreasing width, and another reinforcing portion may have a triangular shape with a gradually increasing width. As shown in FIG. 4F, the reinforcing portion having a width gradually increasing in a direction from the substrate 10 toward the first external electrode 50*a* may have a trapezoidal shape.

Figure 3G:
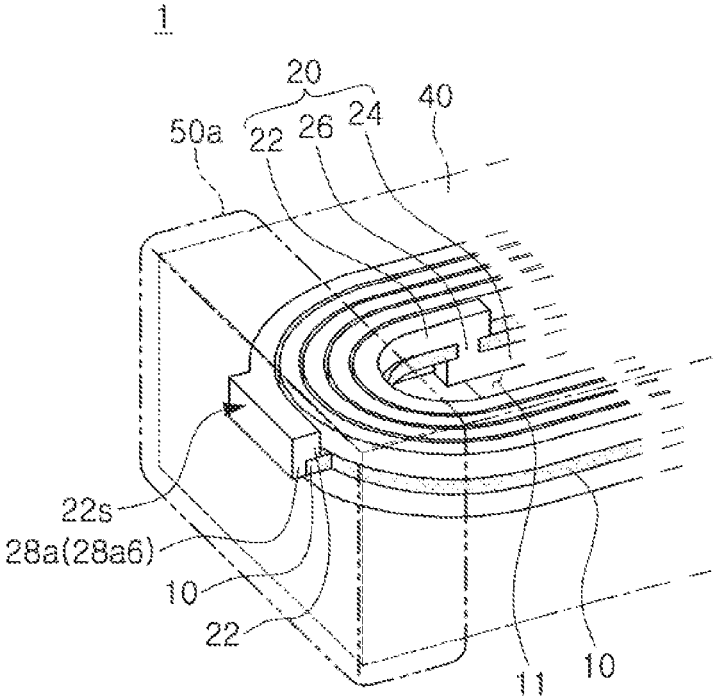
FIG. 3G is a partial perspective view illustrating a modified example of a portion of an inductor according to an exemplary embodiment in the present disclosure.

In a modified example, referring to FIG. 3G together with FIGS. 1 and 2, the first reinforcing portion 28*a* may be a first reinforcing portion 28*a*7 extending from the entire first side 22*s* of the first conductive pattern 22 in the first direction D1.

Next, various examples of the second reinforcing portion 28*b* will be described with reference to FIGS. 4A through 4G. FIGS. 4A through 4G are partial perspective view illustrating various examples of the second reinforcing portion 28*b*.

Figure 4A:
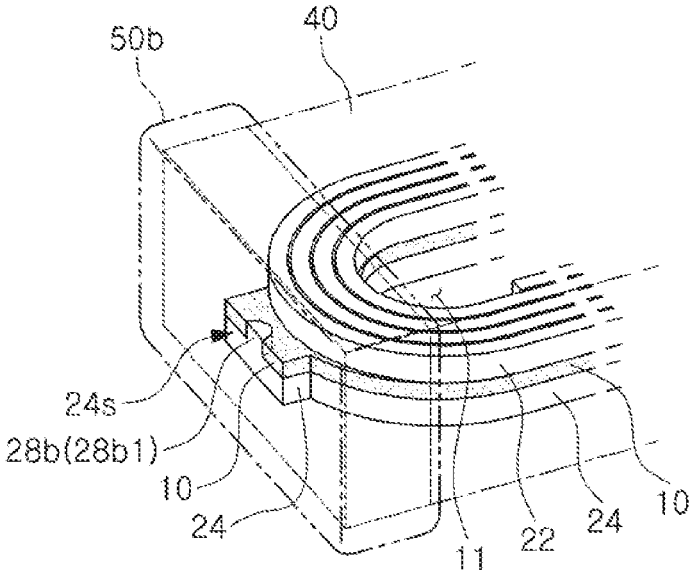
FIG. 4A is a partial perspective view illustrating an example of another portion of an inductor according to an exemplary embodiment in the present disclosure.

In an example, referring to FIG. 4A together with FIGS. 1 and 2, the second reinforcing portion 28*b* may be a second reinforcement 28*b*1 having a hemispherical shape, when viewed in a plan view.

Figure 4B:
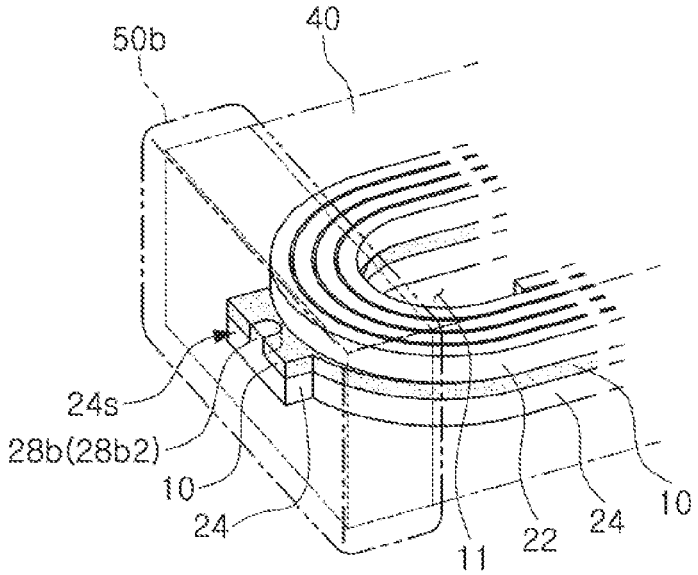
FIG. 4B is a partial perspective view illustrating a modified example of another portion of an inductor according to an exemplary embodiment in the present disclosure.

In a modified example, referring to FIG. 4B together with FIGS. 1 and 2, the second reinforcing portion 28*b* may be a second reinforcement 28*b*2 having a shape of an elongated hemisphere with a constant width, when viewed in a plan view.

Figure 4C:
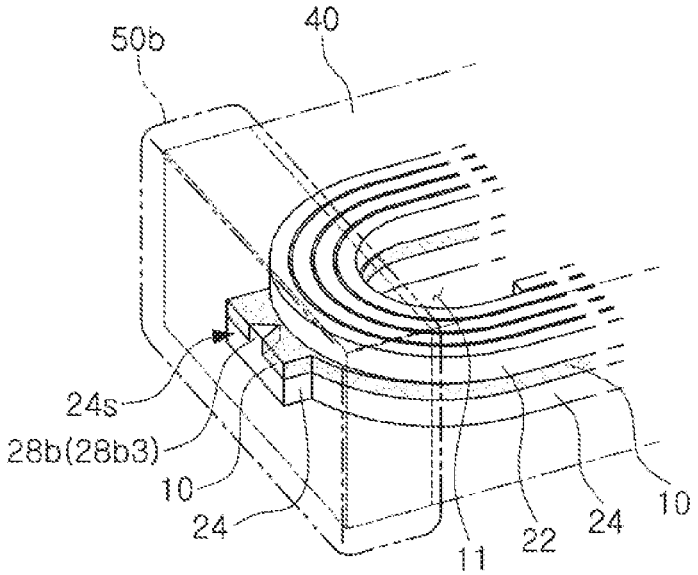
FIG. 4C is a partial perspective view illustrating a modified example of another portion of an inductor according to an exemplary embodiment in the present disclosure.

In a modified example, referring to FIG. 4C together with FIGS. 1 and 2, the second reinforcing portion 28*b* may be a second reinforcing portion 28*b*3 having a triangular shape with a gradually decreasing width, when viewed in a plan view.

Figure 4D:
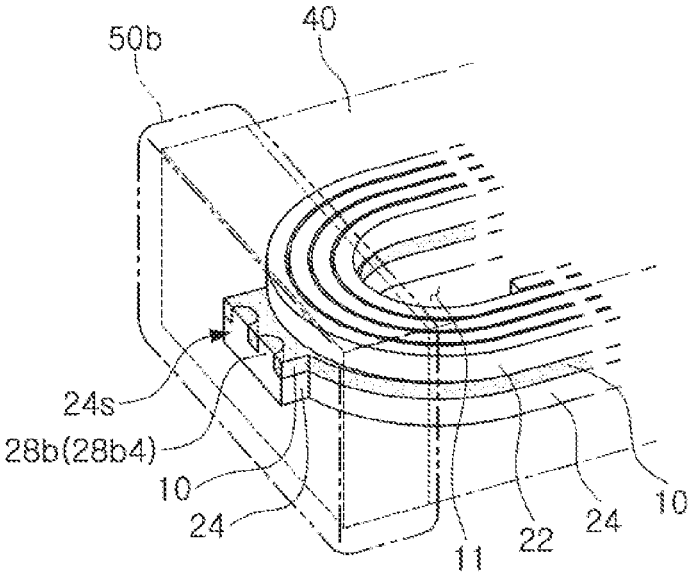
FIG. 4D is a partial perspective view illustrating a modified example of another portion of an inductor according to an exemplary embodiment in the present disclosure.

In a modified example, referring to FIG. 4D together with FIGS. 1 and 2, the second reinforcing portion 28*b* may be a plurality of second reinforcing portions 28*b*4 extending from a plurality of portions of the second side 24*s* of the second conductive pattern 24 in the second direction D2. Each of the plurality of second reinforcing portions 28*b*4 may have a hemispherical shape as described above with reference to FIG. 4A, when viewed in a plan view.

Figure 4E:
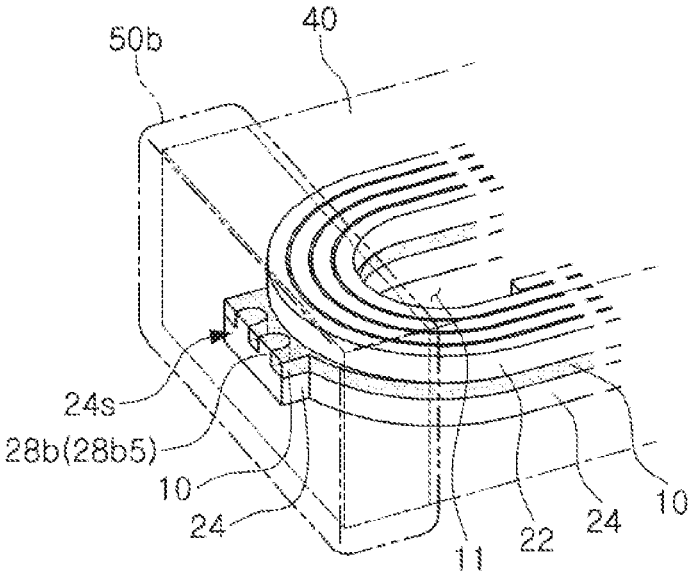
FIG. 4E is a partial perspective view illustrating a modified example of another portion of an inductor according to an exemplary embodiment in the present disclosure.
Figure 4F:
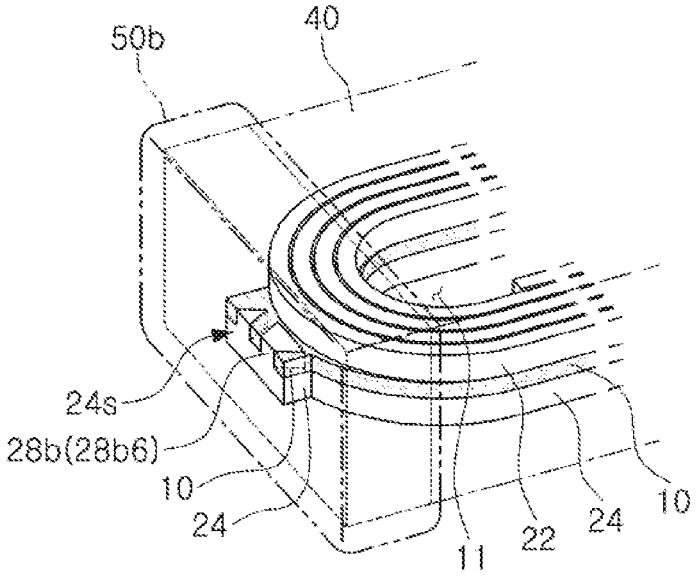
FIG. 4F is a partial perspective view illustrating a modified example of another portion of an inductor according to an exemplary embodiment in the present disclosure.

In a modified example, referring to FIG. 4E together with FIGS. 1 and 2, the second reinforcing portion 28*b* may be a plurality of second reinforcing portions 28*b*5 extending from a plurality of portions of the second side 24*s* of the second conductive pattern 24 in the second direction D2. Each of the plurality of second reinforcing portions 28*b*5 may have a shape of an elongated hemisphere as described above with reference to FIG. 4B, when viewed in a plan view.

In a modified example, referring to FIG. 4F together with FIGS. 1 and 2, the second reinforcing portion 28*b* may be a plurality of second reinforcing portions 28*b*6 extending from a plurality of portions of the second side 24*s* of the second conductive pattern 24 in the second direction D2. Each of the plurality of second reinforcing portions 28*b*6 may have a triangular shape, when viewed in a plan view. In a horizontal direction, the plurality of second reinforcing portions 28*b*6 may include a reinforcing portion having a width gradually decreasing in a direction from the second external electrode 50*b* toward the substrate 10, and a reinforcing portion having a width gradually increasing in a direction from the substrate 10 toward the second external electrode 50*b*. In an example, when viewed in the plan view, any one reinforcing portion among the plurality of second reinforcing portions 28*b*6 may have a triangular shape with a gradually decreasing width, and another reinforcing portion may have a triangular shape with a gradually increasing width. As shown in FIG. 4F, the reinforcing portion having a width gradually increasing in a direction from the substrate 10 toward the second external electrode 50*b* may have a trapezoidal shape.

Figure 4G:
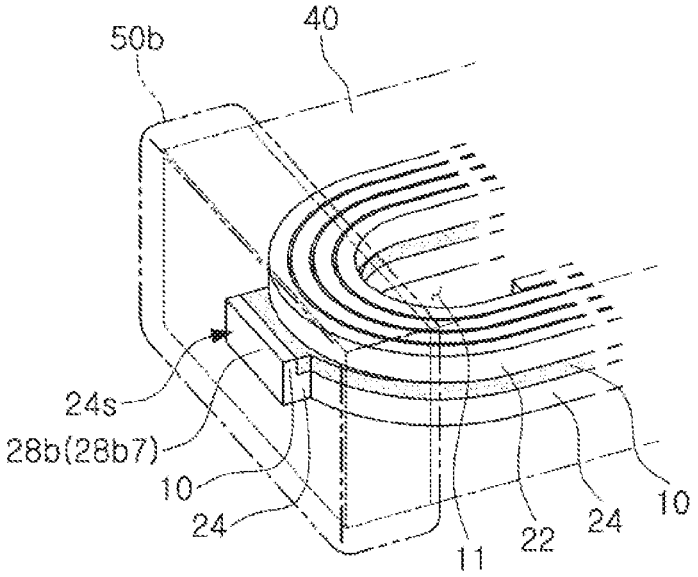
FIG. 4G is a partial perspective view illustrating a modified example of another portion of an inductor according to an exemplary embodiment in the present disclosure.

In a modified example, referring to FIG. 4G together with FIGS. 1 and 2, the second reinforcing portion 28*b* may be a second reinforcing portion 28*b*7 extending from the entire second side 24*s* of the second conductive pattern 24 in the second direction D2.

Figure 5:
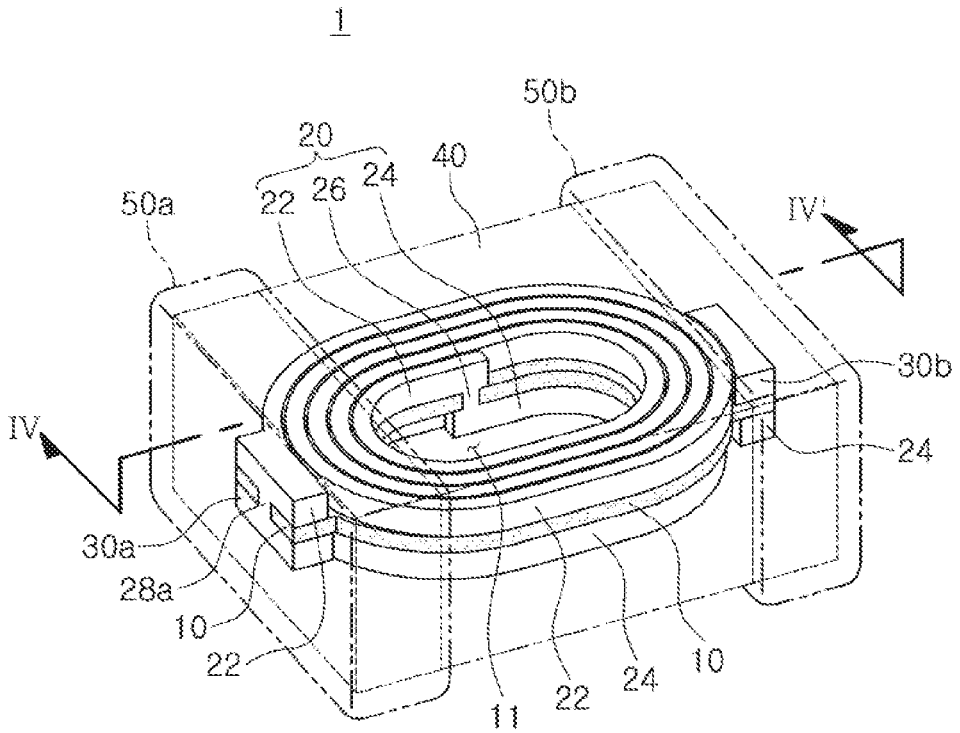
FIG. 5 is a perspective view illustrating a modified example of an inductor according to an exemplary embodiment in the present disclosure.

The conductive structure 20 is not limited to the structures described above with reference to FIGS. 1 through 4G, and may be variously modified. The conductive structure 20 that may be modified will be described with reference to FIGS. 5 and 6. FIG. 5 is a perspective view schematically illustrating an inductor according to an exemplary embodiment in the present disclosure, and FIG. 6 is a cross-sectional view schematically illustrating a region taken along line IV-IV' of FIG. 5.

Figure 6:
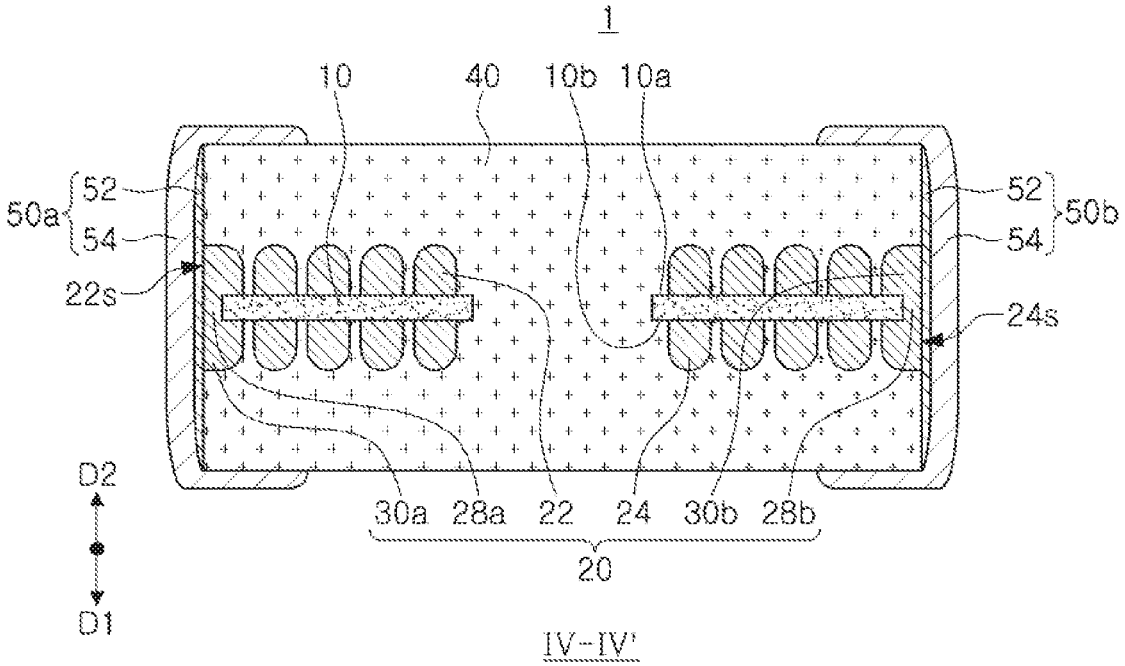
FIG. 6 is a cross-sectional view illustrating a modified example of an inductor according to an exemplary embodiment in the present disclosure.

Referring to FIGS. 5 and 6, an inductor 1 according to an exemplary embodiment in the present disclosure may include the substrate 10, the body 40, and the first and second external electrodes 50*a* and 50*b* that are the same as those described above with reference to FIGS. 1 and 2.

The inductor 1 according to an exemplary embodiment in the present disclosure may include a conductive structure 20 that may be modified. The conductive structure 20 may include the first conductive pattern 22 having the first side 22*s*, the second conductive pattern 24 having the second side 24*s*, and the connection via 26 that are the same as those described above with reference to FIGS. 1 and 2. The conductive structure 20 may include the first reinforcing portion 28*a* that is the same as that described above with reference to each of FIGS. 3A and 3G, and the second reinforcing portion 28*b* that is the same as that described above with reference to each of FIGS. 4A and 4G.

The conductive structure 20 may include at least one expansion part that may increase a contact area with at least one of the first and second external electrodes 50*a* and 50*b*.

In an example, the at least one expansion part may include a first expansion part 30*a* that faces the first side 22*s* of the first conductive pattern 22, that is connected to the first reinforcing portion 28*a* and that is spaced apart from the second conductive pattern 24.

In an example, the at least one expansion part may include a second expansion part 30*b* that faces the second side 24*s* of the second conductive pattern 24, that is connected to the second reinforcing portion 28*b* and that is spaced apart from the first conductive pattern 22.

In an example, the at least one expansion part may include either one or both of the first expansion part 30*a* and the second expansion part 30*b*.

In the inductor 1 according to an exemplary embodiment in the present disclosure, the conductive structure 20 may be formed to have various shapes as described above. For example, in the inductor 1 according to an exemplary embodiment in the present disclosure, the first reinforcing portion 28*a* of the conductive structure 20 may have any one shape among various shapes such as those described above with reference to FIGS. 3A through 3G, and the second reinforcing portion 28*b* of the conductive structure 20 have any one shape among various shapes such as those described above with reference to FIGS. 4A through 4G. In addition, in the inductor 1 according to an exemplary embodiment in the present disclosure, the conductive structure 20 may include either one or both of the first expansion part 30*a* and the second expansion part 30*b*.

Hereinafter, examples of the conductive structure 20 that may be formed in various shapes, will be described with reference to FIGS. 7 through 29. Each of FIGS. 7 through 29 illustrates cross sections of the inductor 1 of FIG. 5 corresponding to a cross section taken along line II-II' of FIG. 1 and a cross section taken along line III-III' of FIG. 1. Here, in description with reference to each of FIGS. 7 through 29, a detailed description of the above-described elements is omitted, and a description thereof will be given directly referring to FIGS. 7 through 29. In addition, the body 40 and the first and second external electrodes 50*a* and 50*b* disclosed in FIGS. 7 through 29 have been described above, and thus may be understood as those described above unless otherwise specified.

Figure 7:
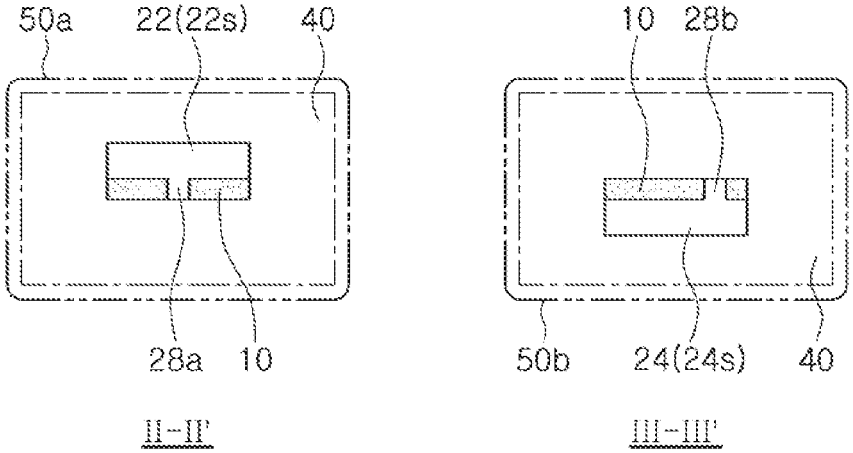
FIG. 7 is a cross-sectional view illustrating a portion of an inductor according to an exemplary embodiment in the present disclosure.

In an example, referring to FIG. 7, a conductive structure 20 may include a first reinforcing portion 28*a* extending from any one portion of the first side 22*s* of the first conductive pattern and penetrating through the substrate 10, and a second reinforcing portion 28*b* extending from any one portion of the second side 24*s* of the second conductive pattern 24 and penetrating through the substrate 10.

Figure 8:
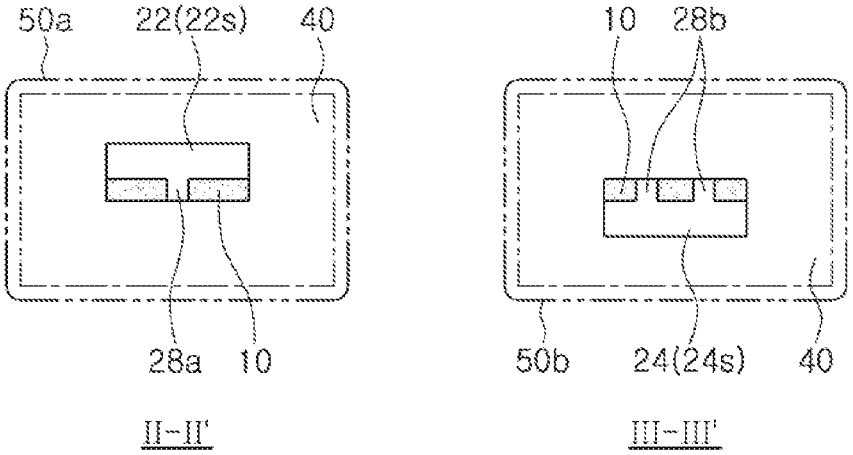
FIG. 8 is a cross-sectional view illustrating a modified example of an inductor according to an exemplary embodiment in the present disclosure.

In another example, referring to FIG. 8, a conductive structure 20 may include a first reinforcing portion 28*a* extending from any one portion of the first side 22*s* of the first conductive pattern 22 and penetrating through the substrate 10, and a second reinforcing portion 28*b* extending from a plurality of portions of the second side 24*s* of the second conductive pattern 24 and penetrating through the substrate 10.

Figure 9:
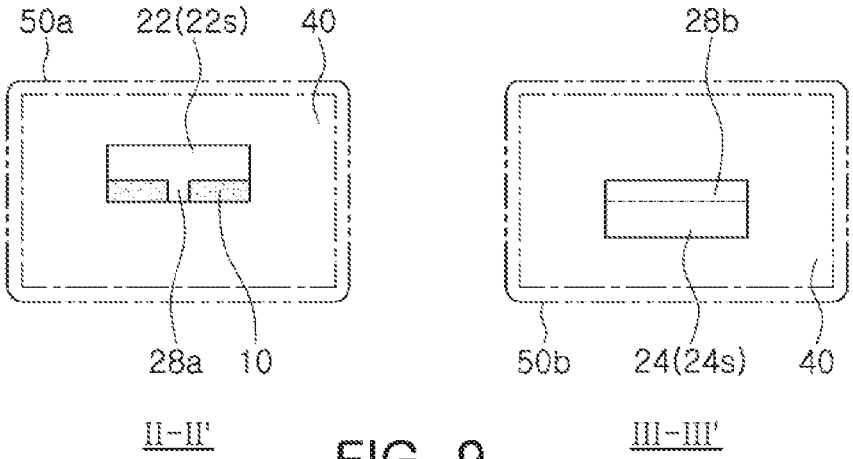
FIG. 9 is a cross-sectional view illustrating a modified example of an inductor according to an exemplary embodiment in the present disclosure.

In another example, referring to FIG. 9, a conductive structure 20 may include a first reinforcing portion 28*a* extending from any one portion of the first side 22*s* of the first conductive pattern 22 and penetrating through the substrate 10, and a second reinforcing portion 28*b* extending from the entire second side 24*s* of the second conductive pattern 24. Here, a portion of the substrate 10 adjacent to the first reinforcing portion 28*a* and the first side 22*s* of the first conductive pattern 22 may be in direct contact with the first external electrode 50*a*, and the second reinforcing portion 28*b* may isolate the substrate 10 from the second external electrode 50*b*.

Figure 10:
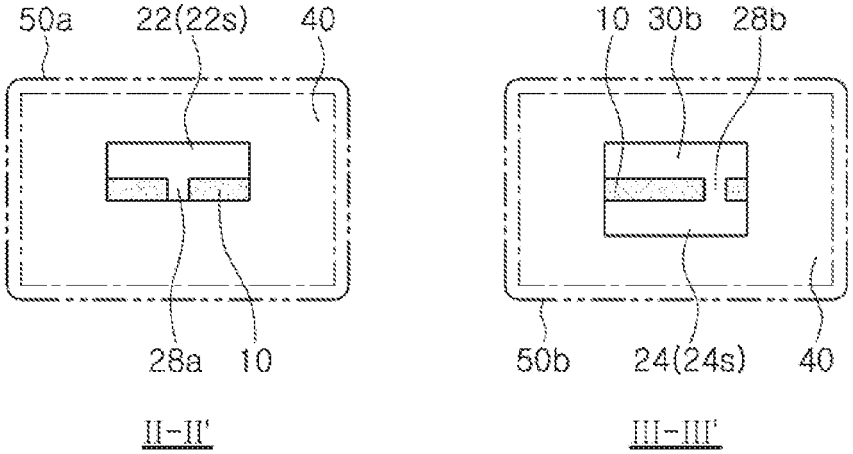
FIG. 10 is a cross-sectional view illustrating a modified example of an inductor according to an exemplary embodiment in the present disclosure.

In another example, referring to FIG. 10, a conductive structure 20 may include a first reinforcing portion 28*a* extending from any one portion of the first side 22*s* of the first conductive pattern 22 and penetrating through the substrate 10, a second reinforcing portion 28*b* extending from any one portion of the second side 24*s* of the second conductive pattern 24 and penetrating through the substrate 10, and a second expansion part 30*b* facing the second side 24*s* of the second conductive pattern 24 and connected to the second reinforcing portion 28*b*.

Figure 11:
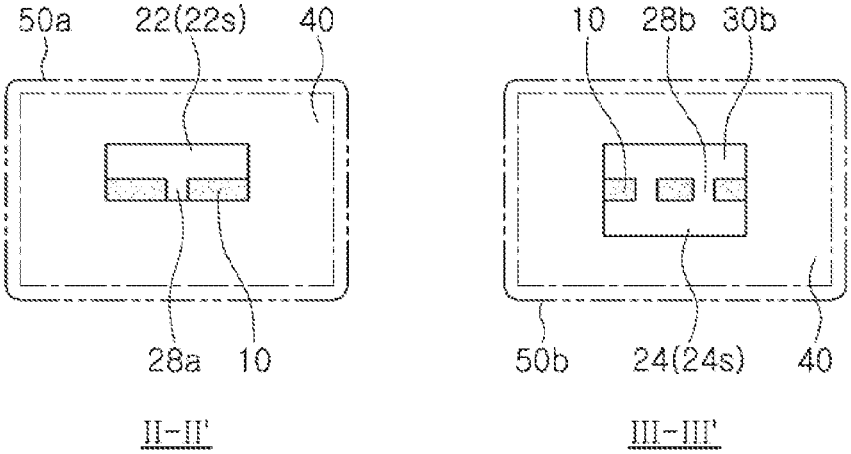
FIG. 11 is a cross-sectional view illustrating a modified example of an inductor according to an exemplary embodiment in the present disclosure.

In another example, referring to FIG. 11, a conductive structure 20 may include a first reinforcing portion 28*a* extending from any one portion of the first side 22*s* of the first conductive pattern 22 and penetrating through the substrate 10, a second reinforcing portion 28*b* extending from a plurality of portions of the second side 24*s* of the second conductive pattern 24 and penetrating through the substrate 10, and a second expansion part 30*b* facing the second side 24*s* of the second conductive pattern 24 and connected to the second reinforcing portion 28*b*.

Figure 12:
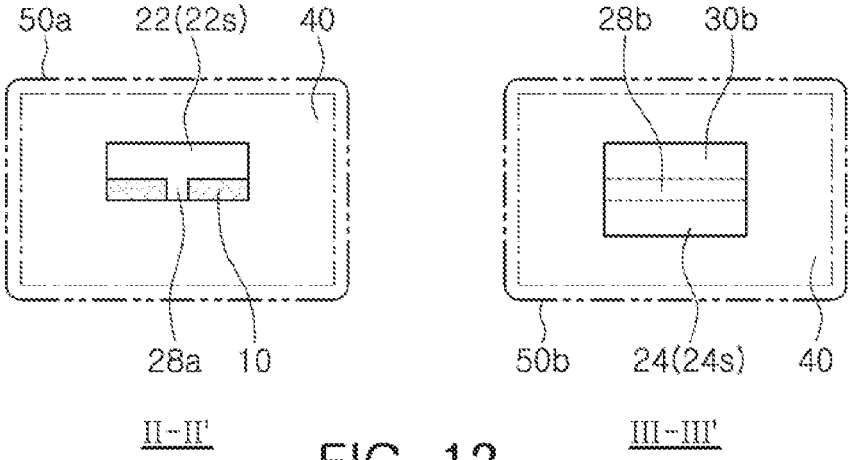
FIG. 12 is a cross-sectional view illustrating a modified example of an inductor according to an exemplary embodiment in the present disclosure.

In another example, referring to FIG. 12, a conductive structure 20 may include a first reinforcing portion 28*a* extending from any one portion of the first side 22*s* of the first conductive pattern 22 and penetrating through the substrate 10, a second reinforcing portion 28*b* extending from the entire second side 24*s* of the second conductive pattern 24, and a second expansion part 30*b* facing the second side 24*s* of the second conductive pattern 24 and connected to the second reinforcing portion 28*b*.

Figure 13:
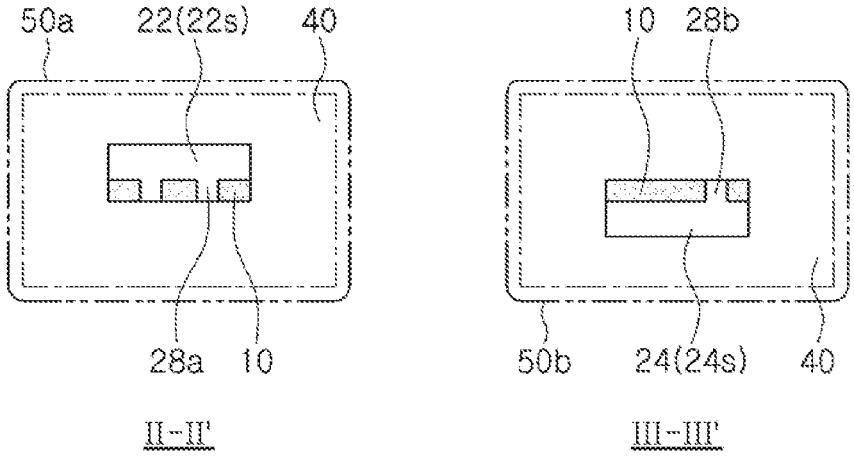
FIG. 13 is a cross-sectional view illustrating a modified example of an inductor according to an exemplary embodiment in the present disclosure.

In another example, referring to FIG. 13, a conductive structure 20 may include a first reinforcing portion 28*a* extending from a plurality of portions of the first side 22*s* of the first conductive pattern 22 and penetrating through the substrate 10, and a second reinforcing portion 28*b* extending from any one portion of the second side 24*s* of the second conductive pattern 24 and penetrating through the substrate 10.

Figure 14:
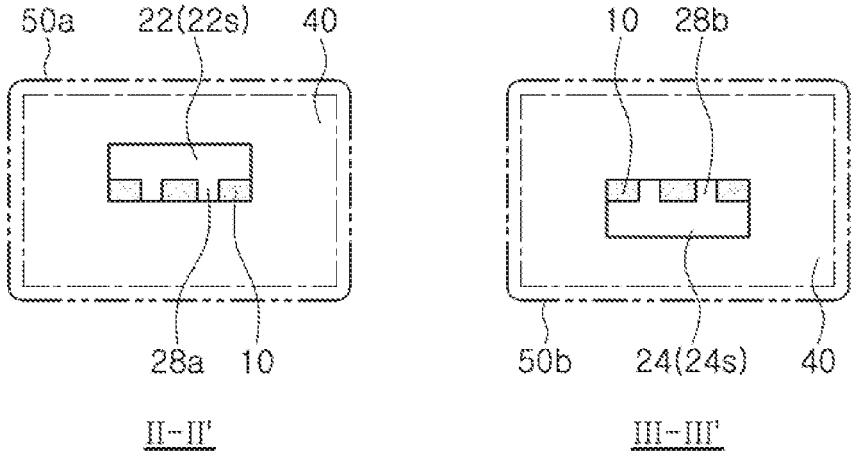
FIG. 14 is a cross-sectional view illustrating a modified example of an inductor according to an exemplary embodiment in the present disclosure.

In another example, referring to FIG. 14, a conductive structure 20 may include a first reinforcing portion 28*a* extending from a plurality of portions of the first side 22*s* of the first conductive pattern 22 and penetrating through the substrate 10, and a second reinforcing portion 28*b* extending from a plurality of portions of the second side 24*s* of the second conductive pattern 24 and penetrating through the substrate 10.

Figure 15:
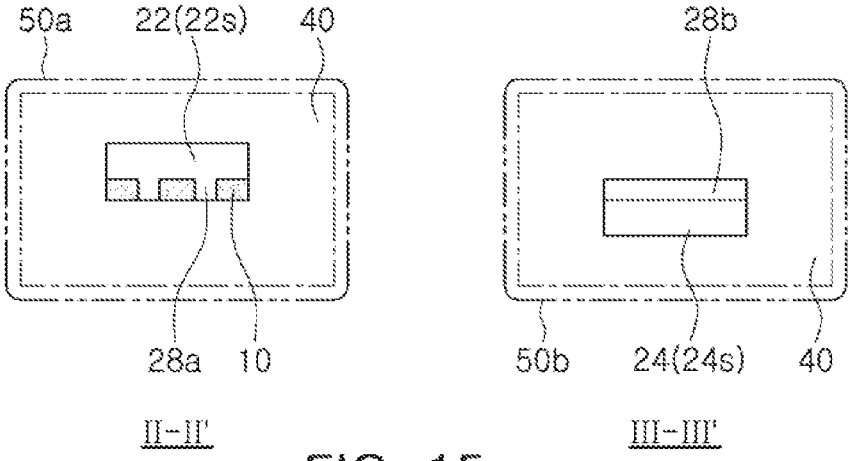
FIG. 15 is a cross-sectional view illustrating a modified example of an inductor according to an exemplary embodiment in the present disclosure.

In another example, referring to FIG. 15, a conductive structure 20 may include a first reinforcing portion 28*a* extending from a plurality of portions of the first side 22*s* of the first conductive pattern 22 and penetrating through the substrate 10, and a second reinforcing portion 28*b* extending from the entire second side 24*s* of the second conductive pattern 24.

Figure 16:
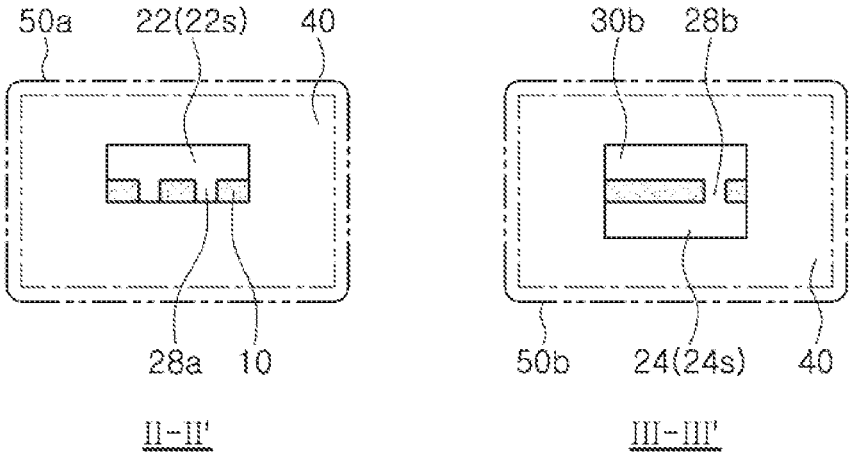
FIG. 16 is a cross-sectional view illustrating a modified example of an inductor according to an exemplary embodiment in the present disclosure.

In another example, referring to FIG. 16, a conductive structure 20 may include a first reinforcing portion 28*a* extending from a plurality of portions of the first side 22*s* of the first conductive pattern 22 and penetrating through the substrate 10, a second reinforcing portion 28*b* extending from any one portion of the second side 24*s* of the second conductive pattern 24 and penetrating through the substrate 10, and a second expansion part 30*b* facing the second side 24*s* of the second conductive pattern 24 and connected to the second reinforcing portion 28*b*.

Figure 17:
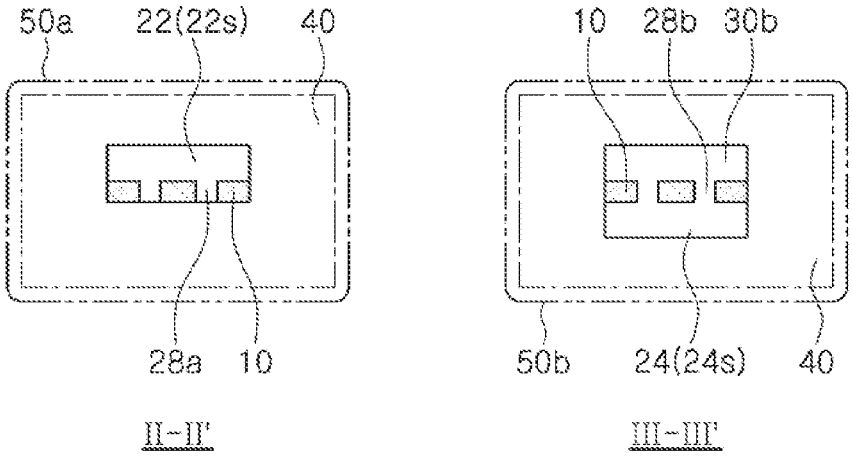
FIG. 17 is a cross-sectional view illustrating a modified example of an inductor according to an exemplary embodiment in the present disclosure.

In another example, referring to FIG. 17, a conductive structure 20 may include a first reinforcing portion 28*a* extending from a plurality of portions of the first side 22*s* of the first conductive pattern 22 and penetrating through the substrate 10, a second reinforcing portion 28*b* extending from a plurality of portions of the second side 24*s* of the second conductive pattern 24 and penetrating through the substrate 10, and a second expansion part 30*b* facing the second side 24*s* of the second conductive pattern 24 and connected to the second reinforcing portion 28*b*.

Figure 18:
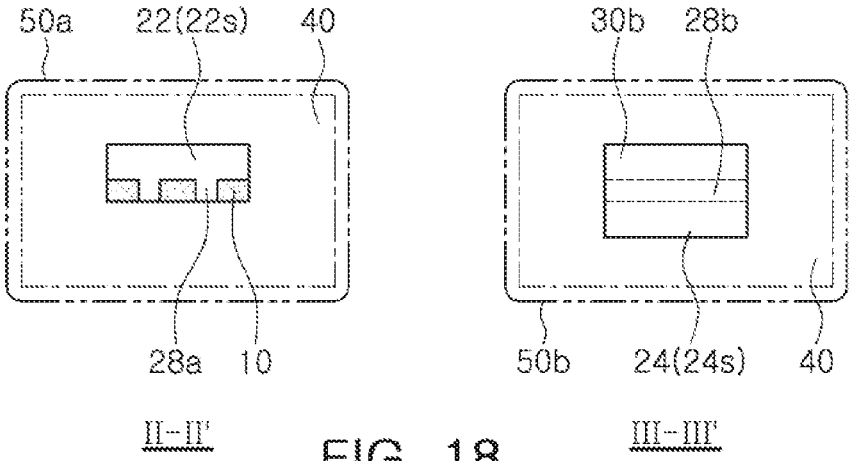
FIG. 18 is a cross-sectional view illustrating a modified example of an inductor according to an exemplary embodiment in the present disclosure.

In another example, referring to FIG. 18, a conductive structure 20 may include a first reinforcing portion 28*a* extending from a plurality of portions of the first side 22*s* of the first conductive pattern 22 and penetrating through the substrate 10, a second reinforcing portion 28*b* extending from the entire second side 24*s* of the second conductive pattern 24, and a second expansion part 30*b* facing the second side 24*s* of the second conductive pattern 24 and connected to the second reinforcing portion 28*b*.

Figure 19:
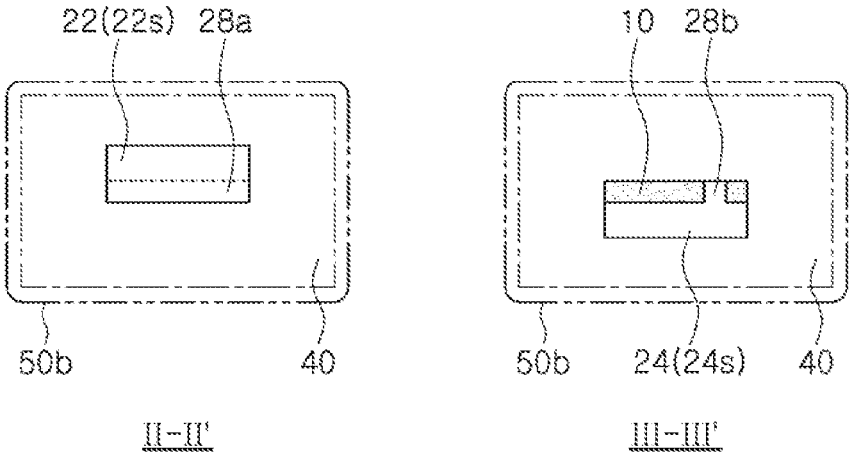
FIG. 19 is a cross-sectional view illustrating a modified example of an inductor according to an exemplary embodiment in the present disclosure.

In another example, referring to FIG. 19, a conductive structure 20 may include a first reinforcing portion 28*a* extending from the entire first side 22*s* of the first conductive pattern 22, and a second reinforcing portion 28*b* extending from any one portion of the second side 24*s* of the second conductive pattern 24 and penetrating through the substrate 10.

Figure 20:
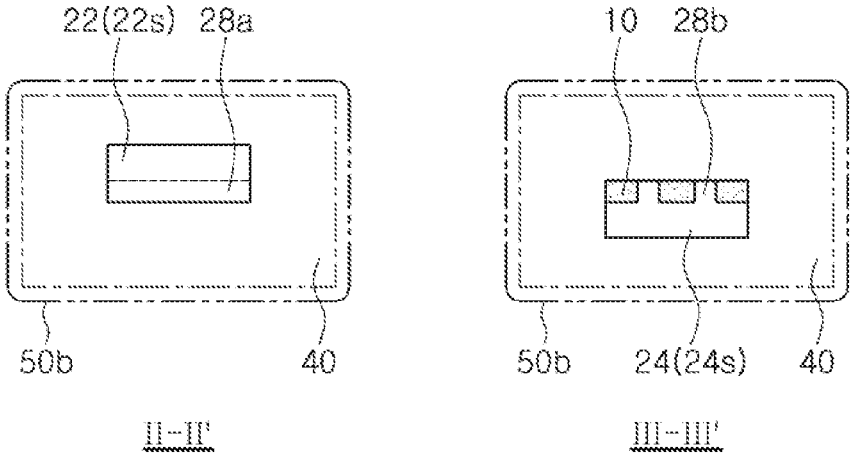
FIG. 20 is a cross-sectional view illustrating a modified example of an inductor according to an exemplary embodiment in the present disclosure.

In another example, referring to FIG. 20, a conductive structure 20 may include a first reinforcing portion 28*a* extending from the entire first side 22*s* of the first conductive pattern 22, and a second reinforcing portion 28*b* extending from a plurality of portions of the second side 24*s* of the second conductive pattern 24.

Figure 21:
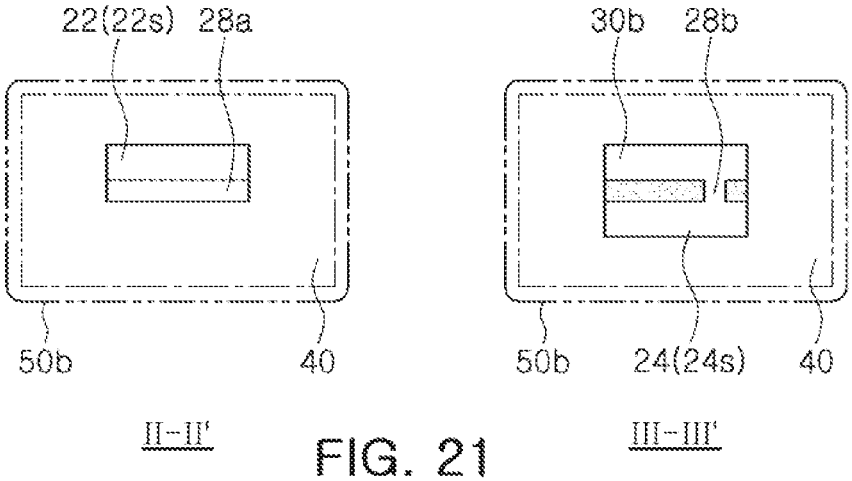
FIG. 21 is a cross-sectional view illustrating a modified example of an inductor according to an exemplary embodiment in the present disclosure.

In another example, referring to FIG. 21, a conductive structure 20 may include a first reinforcing portion 28*a* extending from the entire first side 22*s* of the first conductive pattern 22, a second reinforcing portion 28*b* extending from any one portion of the second side 24*s* of the second conductive pattern 24 and penetrating through the substrate 10, and a second expansion part 30*b* facing the second side 24*s* of the second conductive pattern 24 and connected to the second reinforcing portion 28*b*.

Figure 22:
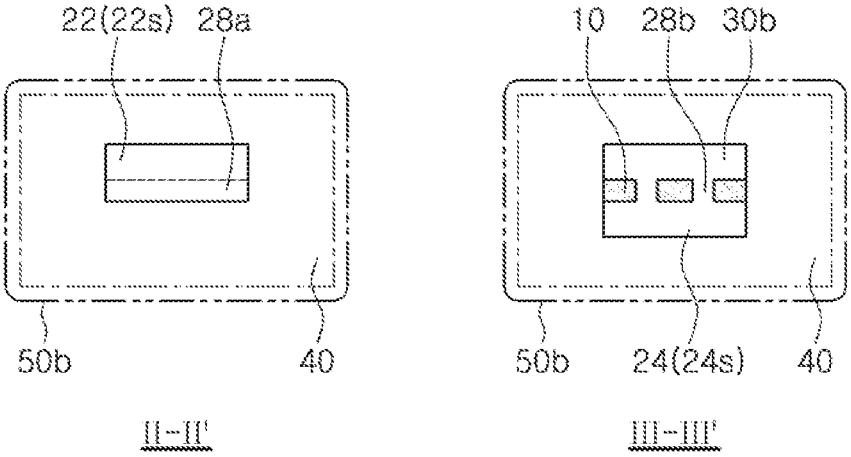
FIG. 22 is a cross-sectional view illustrating a modified example of an inductor according to an exemplary embodiment in the present disclosure.

In another example, referring to FIG. 22, a conductive structure 20 may include a first reinforcing portion 28*a* extending from the entire first side 22*s* of the first conductive pattern 22, a second reinforcing portion 28*b* extending from a plurality of portions of the second side 24*s* of the second conductive pattern 24 and penetrating through the substrate 10, and a second expansion part 30*b* facing the second side 24*s* of the second conductive pattern 24 and connected to the second reinforcing portion 28*b*.

Figure 23:
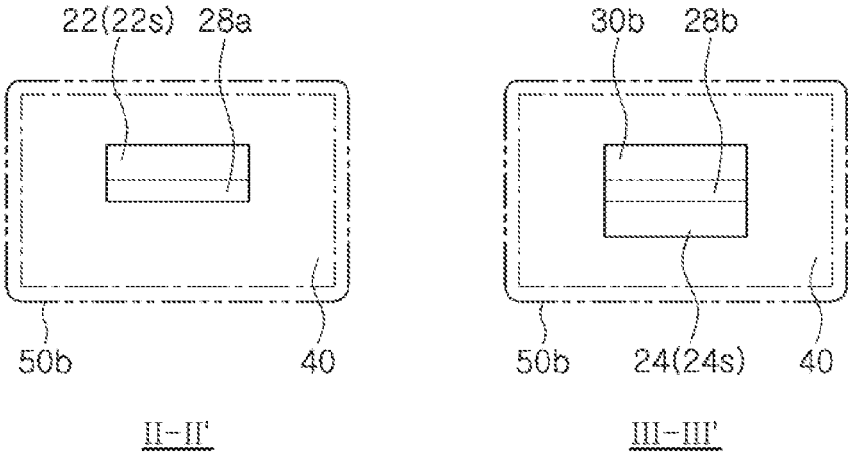
FIG. 23 is a cross-sectional view illustrating a modified example of an inductor according to an exemplary embodiment in the present disclosure.

In another example, referring to FIG. 23, a conductive structure 20 may include a first reinforcing portion 28*a* extending from the entire first side 22*s* of the first conductive pattern 22, a second reinforcing portion 28*b* extending from the entire second side 24*s* of the second conductive pattern 24, and a second expansion part 30*b* facing the second side 24*s* of the second conductive pattern 24 and connected to the second reinforcing portion 28*b*.

Figure 24:
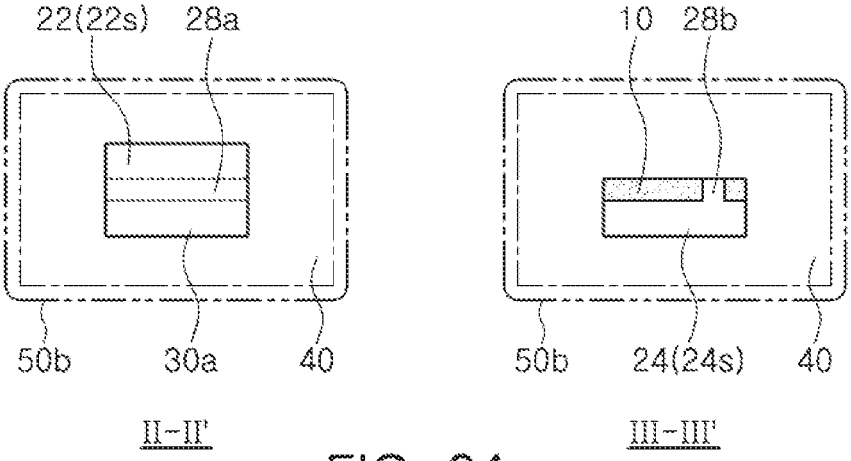
FIG. 24 is a cross-sectional view illustrating a modified example of an inductor according to an exemplary embodiment in the present disclosure.

In another example, referring to FIG. 24, a conductive structure 20 may include a first reinforcing portion 28*a* extending from the entire first side 22*s* of the first conductive pattern 22, a first expansion part 30*a* facing the first side 22*s* of the first conductive pattern 22 and connected to the first reinforcing portion 28*a*, and a second reinforcing portion 28*b* extending from any one portion of the second side 24*s* of the second conductive pattern 24 and penetrating through the substrate 10.

Figure 25:
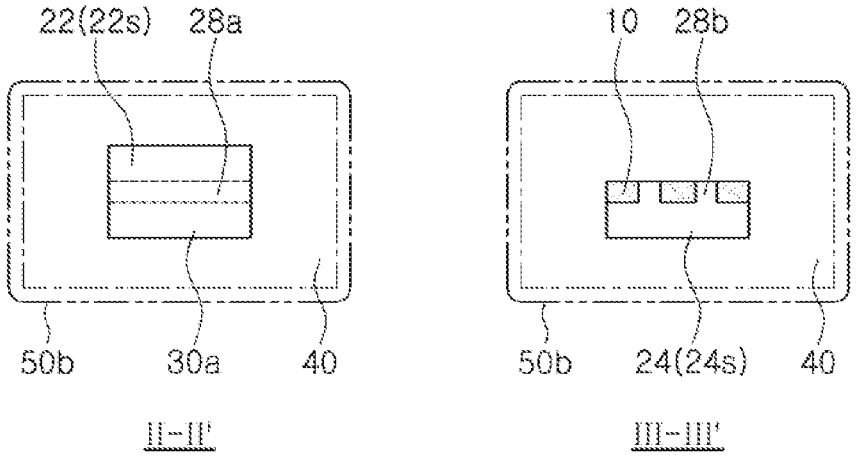
FIG. 25 is a cross-sectional view illustrating a modified example of an inductor according to an exemplary embodiment in the present disclosure.

In another example, referring to FIG. 25, a conductive structure 20 may include a first reinforcing portion 28*a* extending from the entire first side 22*s* of the first conductive pattern 22, a first expansion part 30*a* facing the first side 22*s* of the first conductive pattern 22 and connected to the first reinforcing portion 28*a*, and a second reinforcing portion 28*b* extending from a plurality of portions of the second side 24*s* of the second conductive pattern 24 and penetrating through the substrate 10.

Figure 26:
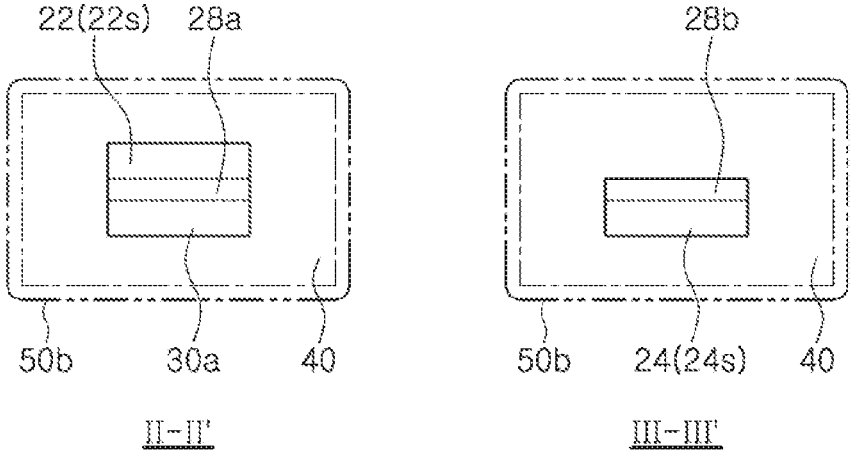
FIG. 26 is a cross-sectional view illustrating a modified example of an inductor according to an exemplary embodiment in the present disclosure.

In another example, referring to FIG. 26, a conductive structure 20 may include a first reinforcing portion 28*a* extending from the entire first side 22*s* of the first conductive pattern 22, a first expansion part 30*a* facing the first side 22*s* of the first conductive pattern 22 and connected to the first reinforcing portion 28*a*, and a second reinforcing portion 28*b* extending from the entire second side 24*s* of the second conductive pattern 24.

Figure 27:
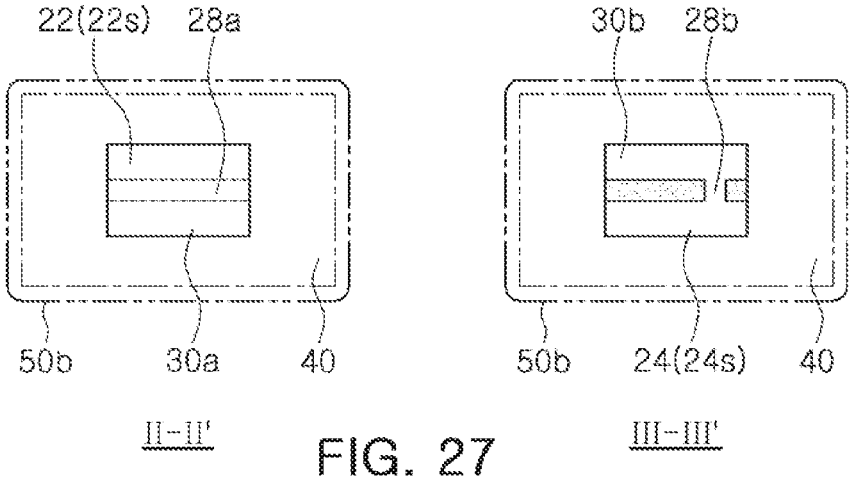
FIG. 27 is a cross-sectional view illustrating a modified example of an inductor according to an exemplary embodiment in the present disclosure.

In another example, referring to FIG. 27, a conductive structure 20 may include a first reinforcing portion 28*a* extending from the entire first side 22*s* of the first conductive pattern 22, a first expansion part 30*a* facing the first side 22*s* of the first conductive pattern 22 and connected to the first reinforcing portion 28*a*, a second reinforcing portion 28*b* extending from any one portion of the second side 24*s* of the second conductive pattern 24 and penetrating through the substrate 10, and a second expansion part 30*b* facing the second side 24*s* of the second conductive pattern 24 and connected to the second reinforcing portion 28*b*.

Figure 28:
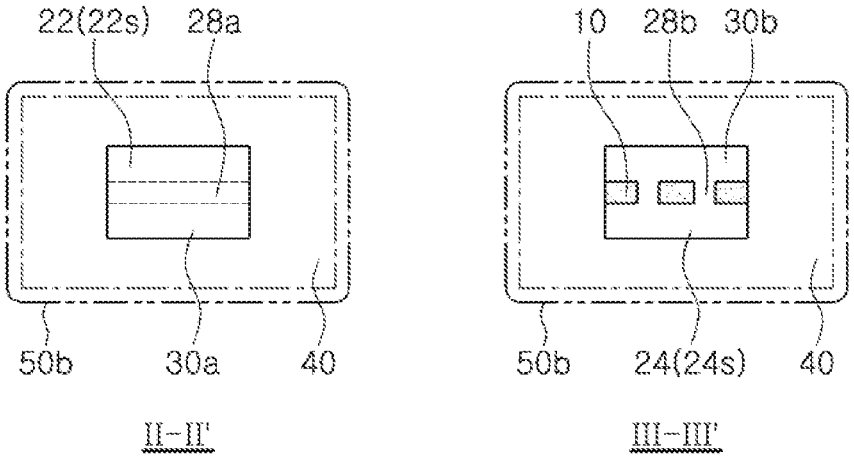
FIG. 28 is a cross-sectional view illustrating a modified example of an inductor according to an exemplary embodiment in the present disclosure.

In another example, referring to FIG. 28, a conductive structure 20 may include a first reinforcing portion 28*a* extending from the entire first side 22*s* of the first conductive pattern 22, a first expansion part 30*a* facing the first side 22*s* of the first conductive pattern 22 and connected to the first reinforcing portion 28*a*, a second reinforcing portion 28*b* extending from a plurality of portions of the second side 24*s* of the second conductive pattern 24 and penetrating through the substrate 10, and a second expansion part 30*b* facing the second side 24*s* of the second conductive pattern 24 and connected to the second reinforcing portion 28*b*.

Figure 29:
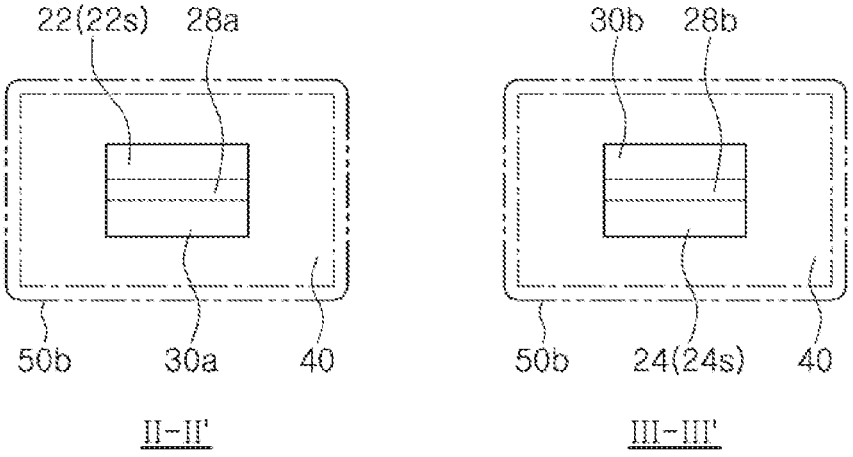
FIG. 29 is a cross-sectional view illustrating a modified example of an inductor according to an exemplary embodiment in the present disclosure.

In another example, referring to FIG. 29, a conductive structure 20 may include a first reinforcing portion 28*a* extending from the entire first side 22*s* of the first conductive pattern 22, a first expansion part 30*a* facing the first side 22*s* of the first conductive pattern 22 and connected to the first reinforcing portion 28*a*, a second reinforcing portion 28*b* extending from the entire second side 24*s* of the second conductive pattern 24, and a second expansion part 30*b* facing the second side 24*s* of the second conductive pattern 24 and connected to the second reinforcing portion 28*b*.

According to the exemplary embodiments, the above-described conductive structure 20 may include the first side 22*s* and the first reinforcing portion 28*a* that are in contact with the first external electrode 50*a*, and the second side 24*s* and the second reinforcing portion 28*b* that are in contact with the second external electrode 50*b*. The first and second reinforcing portions 28*a* and 28*b* of the conductive structure 20 may increase a contact area between the conductive structure 20 and each of the first and second external electrodes 50*a* and 50*b*. Thus, the first and second reinforcing portions 28*a* and 28 may reduce a contact resistance between the conductive structure 20 and each of the first and second external electrodes 50*a* and 50*b*, and may increase a bonding strength between the conductive structure 20 and each of the first and second external electrodes 50*a* and 50*b*. Therefore, it is possible to enhance electrical characteristics of the above-described inductor 1 while enhancing reliability of the inductor 1.

As set forth above, an inductor according to the exemplary embodiments of the present disclosure may include a reinforcing portion capable of increasing a contact area between a conductive structure and an external electrode. When the contact area between the conductive structure and the external electrode increases, a contact resistance between the conductive structure and the external electrode may decrease, and a bonding strength between the conductive structure and the external electrode may increase. Thus, according to the exemplary embodiments of the present disclosure, an inductor having enhanced reliability and enhanced electrical characteristics may be provided.

While exemplary embodiments have been shown and described above, it will be apparent to those skilled in the art that modifications and variations could be made without departing from the scope of the present invention as defined by the appended claim. For example, the abovementioned exemplary embodiments may be partially combined with each other.

What is claimed is:

1. An inductor comprising:

first and second external electrodes spaced apart from each other;

a substrate disposed between the first and second external electrodes, and having a first surface and a second surface opposing each other; and a conductive structure electrically connected to the first and second external electrodes, wherein the conductive structure comprises a first conductive pattern disposed on the first surface of the substrate, a second conductive pattern disposed on the second surface of the substrate, and at least one reinforcing portion, wherein the first conductive pattern has a first side facing the first external electrode, wherein the second conductive pattern has a second side facing the second external electrode, wherein the at least one reinforcing portion is connected to at least one of the first and second sides and is interposed between the substrate and at least one of the first and second external electrodes, wherein the at least one reinforcing portion comprises a first reinforcing portion extending from at least a portion of the first side of the first conductive pattern in a first direction, wherein the first direction is a direction from the first surface of the substrate toward the second surface of the substrate, wherein the conductive structure further comprises a first expansion part spaced apart from the second conductive pattern, wherein the first reinforcing portion is disposed between the first expansion part and the first side of the first conductive pattern, and wherein the first side, the first reinforcing portion, and the first expansion part are in electrical contact with the first external electrode.

2. The inductor of claim 1, wherein at least one of the first and second external electrodes is in direct contact with a portion of the substrate and the at least one reinforcing portion.

3. The inductor of claim 1, wherein the conductive structure further comprises a conductive connection via penetrating through the substrate and electrically connecting the first and second conductive patterns.

4. The inductor of claim 1, wherein a plurality of first reinforcing portions extending from one portion of the first side in the first direction and spaced apart from each other are formed, and wherein a portion of the substrate is in direct contact with the first external electrode.

5. The inductor of claim 1, wherein the entire substrate is spaced apart from the first external electrode, and wherein the first reinforcing portion is interposed between the substrate and the first external electrode.

6. The inductor of claim 1, wherein the at least one reinforcing portion further comprises a second reinforcing portion extending from at least a portion of the second side of the second conductive pattern in a second direction, and wherein the second direction is a direction from the second surface of the substrate toward the first surface of the substrate.

7. The inductor of claim 6, wherein the conductive structure further comprises a second expansion part spaced apart from the first conductive pattern, wherein the second reinforcing portion is disposed between the second expansion part and the second side of the second conductive pattern, and wherein the second side, the second reinforcing portion, and the second expansion part are in electrical contact with the second external electrode.

8. The inductor of claim 6, wherein a plurality of second reinforcing portions extending from one portion of the second side in the second direction and spaced apart from each other are formed, and wherein a portion of the substrate is in direct contact with the second external electrode.

9. The inductor of claim 6, wherein the entire substrate is spaced apart from the second external electrode, and wherein the second reinforcing portion is interposed between the substrate and the second external electrode.

10. The inductor of claim 1, wherein the first or second external electrode comprises inner and outer conductive layers, and the at least one reinforcing portion is in direct contact with the inner conductive layer.

11. The inductor of claim 10, wherein the inner conductive layer overlaps an entirety of the substrate in a thickness direction, and the at least one reinforcing portion is in direct contact with the inner conductive layer where the inner conductive layer overlaps the substrate in the thickness direction.

12. An inductor comprising:

a body;

first and second external electrodes disposed on external surfaces of the body and spaced apart from each other;

a substrate disposed in the body and having a first surface and a second surface opposing each other; and a conductive structure disposed in the body, wherein the conductive structure comprises a first conductive pattern disposed on the first surface of the substrate, a second conductive pattern disposed on the second surface of the substrate, a connection via penetrating through the substrate and electrically connecting the first and second conductive patterns, a first reinforcing portion in contact with the first external electrode, and a second reinforcing portion in contact with the second external electrode, wherein the first conductive pattern has a first side facing the first external electrode and in contact with the first external electrode, wherein the second conductive pattern has a second side facing the second external electrode and in contact with the second external electrode, wherein the first reinforcing portion is electrically connected to the first side and is interposed between the substrate and the first external electrode, wherein the second reinforcing portion is electrically connected to the second side and is interposed between the substrate and the second external electrode, wherein the first reinforcing portion extends from the first side of the first conductive pattern in a first direction, wherein the first direction is a direction from the first surface of the substrate toward the second surface of the substrate, wherein the conductive structure further comprises a first expansion part spaced apart from the second conductive pattern, wherein the first reinforcing portion is disposed between the first expansion part and the first side of the first conductive pattern, and wherein the first side, the first reinforcing portion, and the first expansion part are in electrical contact with the first external electrode.

13. The inductor of claim 12, wherein a plurality of first reinforcing portions or a plurality of second reinforcing portions are formed, or a plurality of first reinforcing portions and a plurality of second reinforcing portions are formed.

14. The inductor of claim 13, wherein each of the plurality of first reinforcing portions or each of the plurality of second reinforcing portions comprises a reinforcing portion having a width gradually decreasing in a direction from an adjacent external electrode among the first and second external electrodes to the substrate, and a reinforcing portion having a width gradually increasing in a direction from the substrate to an adjacent external electrode among the first and second external electrodes.

15. The inductor of claim 13, wherein at least one reinforcing portion of the first and second reinforcing portions has a hemispherical shape, a triangular shape or a shape of an elongated hemisphere having a constant width when viewed in a top view toward the first surface of the substrate.

16. The inductor of claim 12, wherein each of the first and second external electrodes comprises an inner conductive layer, and an outer conductive layer covering the inner conductive layer, and wherein the outer conductive layer comprises a first conductive layer covering the inner conductive layer, and a second conductive layer covering the first conductive layer.

17. The inductor of claim 16, wherein the inner conductive layers overlap an entirety of the substrate in a thickness direction, and the first and second reinforcing portions are in direct contact with the inner conductive layers where the inner conductive layers overlap the substrate in the thickness direction.

* * * * *